US010717581B2

(12) United States Patent
Sullivan, Jr. et al.

(10) Patent No.: US 10,717,581 B2
(45) Date of Patent: Jul. 21, 2020

(54) SEMI-RIGID SHIPPING CONTAINER WITH PEEL-RESEAL CLOSURE

(71) Applicant: CDF Corporation, Plymouth, MA (US)

(72) Inventors: Joseph Sullivan, Jr., Plymouth, MA (US); Joe Wanner, Duxbury, MA (US); Robert Buchenan, Sandwich, MA (US); Steve Gosling, Ontario (CA)

(73) Assignee: CDF CORPORATION, Plymouth, MA (US)

( * ) Notice: Subject to any disclaimer, the term of this patent is extended or adjusted under 35 U.S.C. 154(b) by 106 days.

(21) Appl. No.: 14/493,320

(22) Filed: Sep. 22, 2014

(65) Prior Publication Data

US 2015/0083717 A1 Mar. 26, 2015

Related U.S. Application Data

(60) Provisional application No. 61/880,539, filed on Sep. 20, 2013, provisional application No. 61/946,654, filed on Feb. 28, 2014.

(51) Int. Cl.
*B65D 77/04* (2006.01)
*B65D 77/20* (2006.01)
(Continued)

(52) U.S. Cl.
CPC ..... *B65D 77/2096* (2013.01); *B65D 75/5833* (2013.01); *B65D 77/062* (2013.01); *B65D 77/2032* (2013.01)

(58) Field of Classification Search
CPC ..... B65D 77/04; B65D 77/06; B65D 77/20; B65D 77/2024; B65D 77/2028;
(Continued)

(56) References Cited

U.S. PATENT DOCUMENTS 3,740,238 A 6/1973 Graham
3,885,727 A 5/1975 Gilley
(Continued)

FOREIGN PATENT DOCUMENTS

EP 0796208 B1 3/2000
EP 2484263 A1 8/2012
(Continued)

OTHER PUBLICATIONS

International Search Report and Written Opinion for related International application No. PCT/US15/18160, dated Jun. 8, 2015 (11 pages).

(Continued)

*Primary Examiner* — Andrew D Perreault
(74) *Attorney, Agent, or Firm* — Dorsey & Whitney LLP

(57) ABSTRACT

The present disclosure, in one embodiment, relates to a packaging assembly for holding liquids, viscous material, or particulate material. The packaging assembly includes a carton having side and bottom walls and an open top. A self-supporting plastic liner fits inside of the carton and is for containing liquids, viscous material, or particulate material. The liner has a side wall, a closed bottom end, and an open top end having an outwardly-projecting rim. The rim has a radially-extending flange portion, and a dependent skirt portion. When the self-supporting plastic liner is inside of the carton, the dependent skirt portion of the rim hangs over the side walls of the carton. A lidding material is removeably affixed to the rim of the plastic liner. A carton lid closes off the open top of the carton.

18 Claims, 24 Drawing Sheets

(51) Int. Cl.
*B65D 77/06* (2006.01)
*B65D 75/58* (2006.01)

(58) Field of Classification Search
CPC ..... B65D 77/2032; B65D 77/2036; B65D 77/2048; B65D 77/2056; B65D 77/2068; B65D 77/2096; B65D 77/2076; B65D 77/062
See application file for complete search history.

(56) References Cited

U.S. PATENT DOCUMENTS 3,997,677 A 12/1976 Hirsch et al.
4,141,466 A 2/1979 Gordon et al.
4,397,415 A 8/1983 Lisiecki
4,482,053 A * 11/1984 Alpern ..... A61L 2/26 206/439
4,548,852 A 10/1985 Mitchell
4,671,453 A 6/1987 Cassidy
4,732,301 A 3/1988 Tobias et al.
4,784,885 A 11/1988 Carespodi
4,790,436 A 12/1988 Nakamura
4,924,048 A 5/1990 Bunce et al.
4,972,953 A 11/1990 Friedman et al.
5,124,388 A 6/1992 Pruett et al.
5,167,339 A 12/1992 Takata et al.
5,388,757 A * 2/1995 Lorenzen ..... B65D 51/185 229/123.2
5,503,858 A 4/1996 Reskow
5,582,887 A 12/1996 Etheredge
5,633,058 A 5/1997 Hoffer et al.
5,945,145 A 8/1999 Narsutis et al.
6,296,844 B1 10/2001 Takahashi
6,309,105 B1 10/2001 Palumbo
6,892,933 B2 5/2005 Sullivan, Jr.
6,918,532 B2 7/2005 Sierra-Gomez et al.
7,681,732 B2 * 3/2010 Moehlenbrock ..... B32B 7/12 206/459.1
8,541,081 B1 9/2013 Ranganathan et al.
8,567,660 B2 10/2013 Sullivan et al.
2010/0278454 A1 * 11/2010 Huffer ..... B65D 75/5838 383/5
2011/0114714 A1 5/2011 Sullivan et al.
2012/0261411 A1 10/2012 Buchenan et al.
2013/0206763 A1 8/2013 Sinn et al.
2013/0320019 A1 12/2013 Tinoco
2016/0152400 A1 6/2016 Tinoco

FOREIGN PATENT DOCUMENTS

WO 93/00274 A1 1/1993
WO 03/059776 A1 7/2003
WO 2011/062969 A2 5/2011

OTHER PUBLICATIONS

Extended European Search Report dated Sep. 15, 2017, in European Application No. 15754813.2, 5 pages.

* cited by examiner

SEMI-RIGID SHIPPING CONTAINER WITH PEEL-RESEAL CLOSURE

CROSS-REFERENCE TO RELATED APPLICATIONS

The present application claims priority to U.S. Provisional Patent Application No. 61/880,539 filed Sep. 20, 2013, titled "Semi-Rigid Shipping Container with Peel-Reseal Closure" and to U.S. provisional application No. 61/946,654, filed Feb. 28, 2014, entitled "Semi-Rigid Shipping Container with Peel-Reseal Closure," the contents of both references are incorporated herein by reference in their entirety.

The present application also incorporates herein by reference in their entirety U.S. patent application Ser. No. 12/620,446, filed Nov. 17, 2009, titled "Sustainable Packaging System for Shipping Liquid or Viscous Products," and U.S. patent application Ser. No. 12/767,981, filed Apr. 27, 2010, titled "Sustainable Packaging System For Shipping Liquid or Viscous Products," which is a continuation-in-part of U.S. patent application Ser. No. 12/620,446.

TECHNICAL FIELD

The present disclosure relates to packaging and more particularly to a sustainable packaging system including a carton and a sealed liner assembly for shipping liquid, viscous, or particulate products.

BACKGROUND

Substantially rigid plastic containers with replaceable covers, e.g., bucket-type containers, are commonly used to package and ship selected liquid and viscous materials in the nature of foods and food preparation materials, cosmetic preparations, detergents, and the like. Such containers are sturdy, typically having a wall thickness in the range of about 75 Mils to about 90 Mils, and have a large mouth that renders them well suited for storing and dispensing a variety of viscous liquids, e.g., syrups, mustard, and cosmetic preparations. A typical 20 liter empty bucket may weigh approximately 2¼ lbs.

Another mode of shipping liquid products is the "bag & box" assembly in which a bag, made of flexible single or double ply plastic film and provided with a fitment for discharge of the bag's contents, is stored in a box made of corrugated cardboard. The latter type of packaging system is well suited for free-flowing liquids such as vinegar, wine, detergents, and the like. However, it is not well suited for viscous materials for a number of reasons. For example, it is difficult to remove all of the contents from the bag, due to the inability to scrape out the residual contents from the bag. Additionally, in the case of a material that consists of several ingredients that tend to separate from one another on standing, it is not possible to introduce a stifling implement into the bag for the purpose of mixing the contents to obtain a homogenous material.

Further limitations stem from plastic recycling requirements and food packaging regulations. Environmental regulations require containers with a volume of 5 gallons or less to be made of a recyclable material. Additionally, governmental regulations require that plastic containers for foodstuffs be made of a virgin plastic material. The substantially rigid plastic containers comprise a relatively large amount of plastic in comparison to the flexible bags used in the "bag & box" packaging system, thereby increasing the amount of plastic that has to be disposed of or recycled. Making such containers of virgin plastic is costly and hence discourages their use for containing foodstuffs. The "bag & box" system employs less plastic, but the bags are not as sturdy as the substantially stiff containers and also cannot be used where it is essential to access all of the contents or where it is desired to mix the contents in situ.

SUMMARY

The present disclosure relates to a packaging system and more particularly to a sustainable packaging system including a carton and a sealed liner assembly for shipping liquid, viscous, or particulate products. The present disclosure in one embodiment, relates to a packaging assembly for holding liquids, viscous material, or particulate material. The packaging assembly includes a carton having side and bottom walls. The packaging assembly also includes a self-supporting plastic liner that fits inside of the carton for containing liquids, viscous material, or particulate material. The liner has either a substantially circular or substantially oval cylindrical side wall, a closed bottom end characterized by a bottom wall formed integral with said side wall, and an open top end having an outwardly-projecting rim. The rim has a radially-extending flange portion, and a dependent skirt portion, wherein when the self-supporting plastic liner is inside of the carton, the radially extending flange portion supports the liner on at least a portion of the carton. A lidding material is provided to seal the plastic liner.

In accordance with various embodiments, a packaging assembly for holding contents may include a self-supporting liner. The self-supporting liner may hold contents and having a side wall, a closed bottom end characterized by a bottom wall formed integral with the side wall, and an open top end having an outwardly-projecting rim, said rim comprising a flange portion. The packaging assembly may include a peel-reseal lidding assembly. The peel-reseal lidding assembly may include a first lidding material defined by at least one edge. The lidding material may be heat-sealed to the plastic liner at the at least one edge at the open top end operably sealing the contents therein. A center portion of the first lidding material may be detached from a remaining portion along at least one edge such that the center portion is movable to expose a second lidding material thereunder. The peel-reseal lidding assembly may include a peel-reseal lidding material defined by at least one edge that is sealed to the remaining portion and the center portion across the detached edge. The peel-reseal lidding material is resealable to seal the contents in the plastic liner when the lidding material is broken.

In accordance with various embodiments, a packaging assembly for holding contents may include a self-supporting plastic liner for holding contents. The self-supporting plastic liner may have a side wall, a closed bottom end characterized by a bottom wall formed integral with the side wall, and an open top end having an outwardly-projecting rim, said rim comprising a flange portion. A skirt portion may extend at a downward angle away from the flange portion. The flange portion, the side wall, or the skirt portion may include a plurality of positioning features defined by surface features. The packaging assembly may include a peel-reseal lidding assembly attached to the flange portion. The peel-reseal lidding assembly may include a first lidding material, a second lidding material, and a peel-reseal lidding material. The peel-reseal lidding material may be defined by at least one edge that is sealed across a detached edge of a remaining portion and a center portion of the first lidding material. The detached edge allows the center portion to be movable to expose the second lidding material thereunder. The peel-reseal lidding material may be resealable to retain the contents in the plastic liner when the lidding material is broken.

The present disclosure, in another embodiment, relates to a packaging assembly for holding liquids, viscous material, or particulate material. The packaging system includes a carton having side, top, and bottom walls, and a carton lid near the top wall. The carton has a tear strip or perforation dividing the carton lid from the remainder of the carton. A self-supporting plastic liner is provided inside of the carton for containing liquids, viscous material, or particulate material. The liner may or may not be attached to the carton. The liner has a side wall, a closed bottom end characterized by a bottom wall formed integral with said side wall, and an open top end having an outwardly-projecting rim. The rim has a radially-extending flange portion, and a dependent skirt portion, wherein the radially extending flange portion supports the liner on at least a portion of the carton. Separation along the tear strip or perforation allows the carton lid to at least partially open and expose the liner within the carton.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

The present disclosure relates to a novel and advantageous sustainable packaging system that may be used to ship liquid or viscous products or particulate matter. Traditionally, liquid products, for example thick viscous products such as thick paints and inks, cosmetic compounds, food glazes and fillings, drywall mud, thick roof sealants, powders and flakes, or like products have been packed for shipping or sale in pails or buckets made of materials such as steel or thick plastic. A single traditional 20 liter bucket of this type may weigh approximately 2¼ pounds empty, which adds a considerable amount of weight to a truckload of product. Buckets or pails are also typically cylindrically shaped, making them inefficient for skidding or shipping because there is a substantial amount of unused space between one bucket and the next bucket. Further, due to the rigidity of the buckets, they may take up a significant amount of space after use, but before disposal. Additionally, the buckets may be difficult or costly to dispose of or recycle.

The packaging system of the present disclosure generally includes an outer container or carton box, and an inner liner. The inner liner may be sealed after the liner is filled with product. A liner cover may be placed over the sealed liner and/or a carton box cover may be placed over the cardboard box containing the sealed and filled inner liner. The square or rectangular shape of the packaging system allows one box to be placed directly next to and/or on top of another box, effectively maximizing the amount of product that can be stored or shipped in a limited space. For shipping purposes, the more units that can be loaded per truck reduces inbound transportation costs.

In addition to the advantageous shape of the packaging system of the present disclosure, a single empty packaging system, in one embodiment, may weigh approximately ⅓ pounds, compared to the approximately 2¼ pounds for a traditional pail of similar volume. This weight difference results in a 7½ to 1 ratio in weight savings for the packaging system of the present disclosure over the traditional pail. The lighter weight packaging system of the present disclosure may be easier to move, be less costly to ship, require less energy to produce, and be easier to recycle, and easier to store prior to recycling than traditional pails.

Figure 1A:
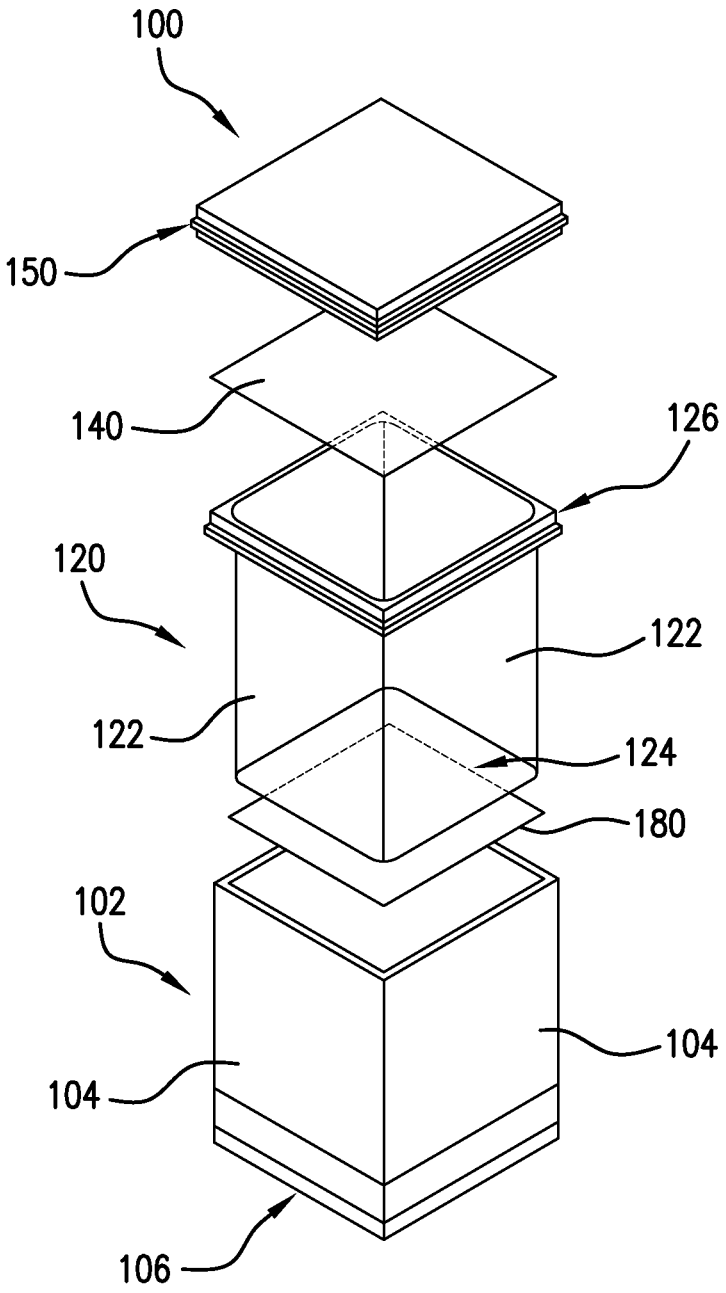
FIG. 1*a* is an exploded perspective view of the components of a packaging system according to one embodiment of the present disclosure.

FIG. 1A shows an embodiment of the packaging system 100 of the present disclosure. The embodiment of the packaging system 100 may include a carton 102, an optional pad or liner 180, a plastic liner 120, a lidding material 140 that may be sealed to the plastic liner 120, and a plastic lid 150. The carton 102 may be a conventional cardboard box constructed of, for instance, corrugated cardboard and a stiff paperboard that may be 100% recyclable, although, other light and/or recyclable materials may be used for the carton. The carton 102 may have a generally square or rectangular cross-sectional shape. Carton 102 may have a sidewall including four square or rectangular panels 104, a bottom wall 106, and in some embodiments, an open top without any flaps that need to be closed and/or sealed.

In one embodiment, the liner 120 may be made of plastic and be relatively semi-rigid and thin, approximately in the range of about 8 mils to about 30 mils thick. However, it is recognized that the liner thickness could vary and could be outside the range of about 8 mils to about 30 mils, and in some embodiments, may depend on the desired use or application of the liner 120. The liner 120 may be made by any means known in the art, such as, but not limited to vacuum forming, blow molding, or injection molding. The liner 120 may be made, for example, of a 100% recyclable material, such as, but not limited to high-density polyethylene (HDPE) or linear low density polyethylene (LLDPE). Unlike the plastic film bags used in the bag & box assembly described above, the liner 120 may be self-supporting. However, the relative thinness of the liner may make the liner easily collapsible, which may significantly reduce the volume and cost of disposal as compared to traditional pails. Due to the thinness and/or the weight of the carton 102 and/or the liner 120, more, and in some cases significantly more, liners may be shipped via truck than traditional rigid buckets. For instance, the liner may be shipped in truckloads of approximately 28,000 units compared to only 3,412 traditional buckets per truck. Increasing the number of liners that may be shipped in a single truck load can advantageously result in less truck loads needed to ship the packaging system of the present disclosure and therefore less greenhouse gases being produced.

Figure 2:
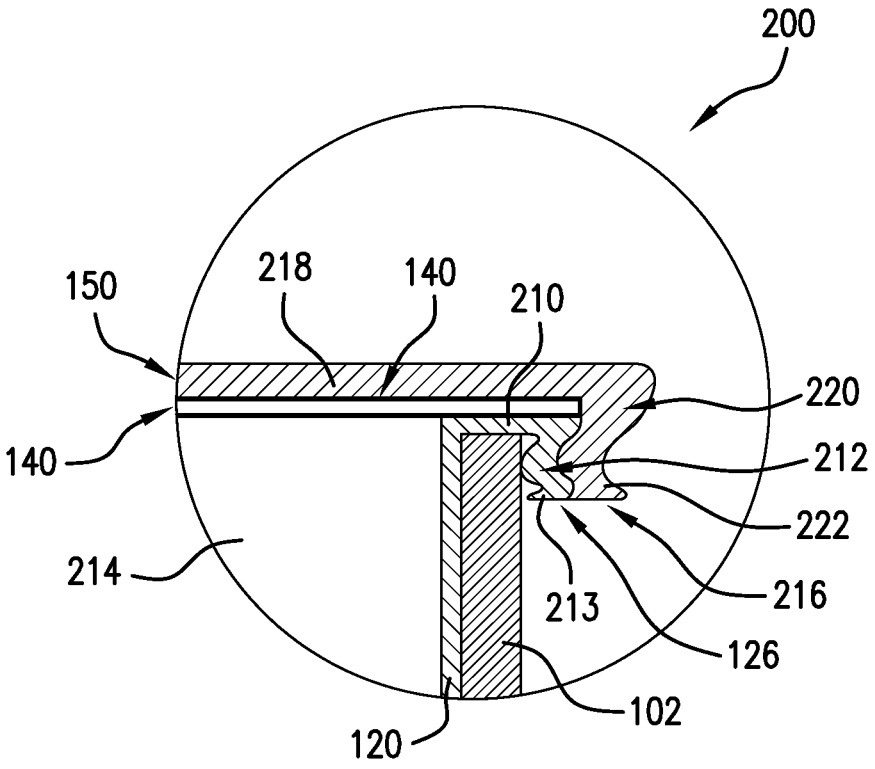
FIG. 2 is an enlarged fragmentary sectional view illustrating the components of a packaging system according to one embodiment of the present disclosure.

The liner 120 may have a cross-sectional shape similar to the carton 102, e.g., square or rectangular cross-sectional shape. Alternately, the liner may have any other shape, such as, but not limited to an oval or round cylindrical shape, as described in more detail below. In any case, the liner 120 can be sized to fit within the carton 102. In the illustrated embodiment, the liner 120 has a substantially square cross-sectional configuration and comprises a bottom wall 124 and a side wall including four sides or panels 122 that can be substantially similar in shape to panels 104 of carton 102. When the plastic liner 120 is inside the carton 102, the plastic liner 120 may rest on and be supported by the bottom wall 106 of the carton 102. Panels 122 may typically be generally slightly smaller than panels 104 of carton so as to permit the liner 120 to fit inside the carton 102. In one embodiment, panels 122 of the plastic liner 120 may lie substantially close to the side walls 104 of the carton 102 when the liner is placed in the carton. The top end of the liner 120 can be open but may be formed with a rim 126. As can best be seen in FIG. 2, the rim 126 of the liner 120 may include a radially extending flange portion 210 and a depending skirt portion 212. The rim 126 may extend fully around the perimeter of the liner 120, being an integral extension of the upper end of the panels 122. In another embodiment, the rim may extend partly around the perimeter of the liner. When the liner 120 is placed in the carton, the top edge of the carton sidewall 104 can be positioned underneath the rim 126 of the liner 120 as can be seen in FIG. 2, with the top edge of the sidewall 104 between the sidewall of the liner 120 and the skirt portion 212.

Figure 1B:
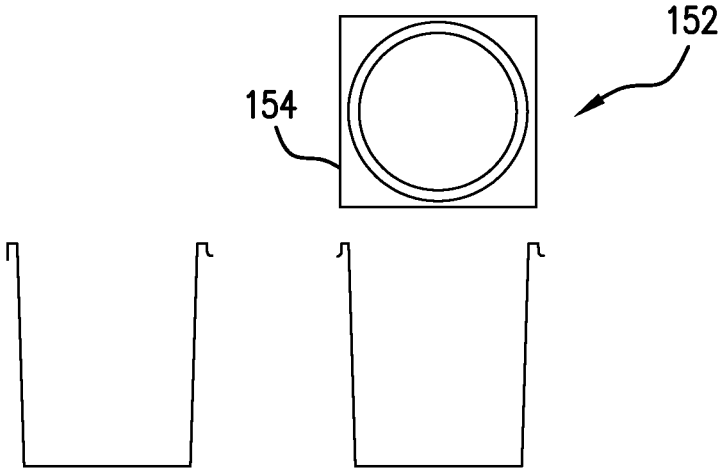
FIG. 1*b* is a top, end, and side view of a round cylindrical liner according to one embodiment of the present disclosure.

As stated above, the liner may have any other suitable shape. For example, in one embodiment, as shown in FIG. 1*b*, a liner 152 may have a substantially circular cross-sectional shape, sized to fit within the carton 102. The top of the liner 152, in one embodiment, may retain a square or rectangular shaped rim 154, such that the rim may extend fully around the perimeter of the liner 152, being an integral extension of the upper end of the liner. In a further embodiment, the rim may extend partly around the perimeter of the liner.

Figure 1C:
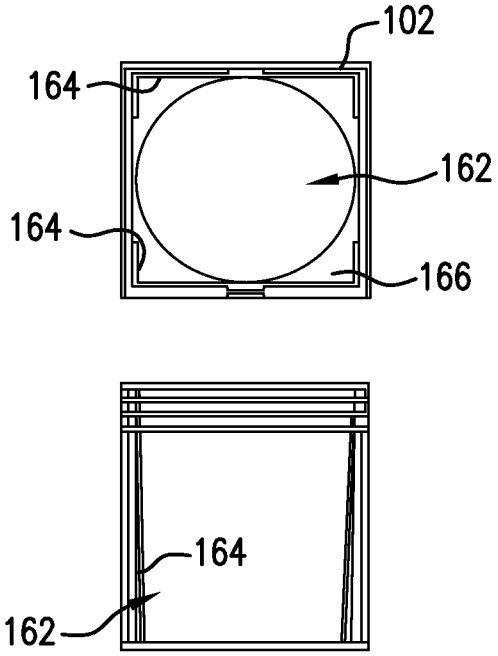
FIG. 1*c* is a top and side view of a packaging system with a round cylindrical liner according to another embodiment of the present disclosure.

In another embodiment of a liner having a substantially circular cross-sectional shape, sized to fit within the carton 102, as shown in FIG. 1*c*, a liner 162 may be designed to fit generally within the carton 102. The carton 102 may include additional inner side panels 164. The inner side panels 164 may extend substantially around the entire inner perimeter of the sidewall panels 104, or they may extend around only a portion of the inner perimeter of the sidewall panels 104. Although not necessary, the inner side panels 164, in some embodiments, may be slightly taller than the outer panels 104. The liner 162 may retain a square or rectangular shaped rim 166, which may extend fully or partly around the perimeter of the liner, and may rest upon an upper edge of the inner side panels 164. The liner 162 may be positioned with the rim 166 over a top edge of the inner side panels 164 entirely within the carton sidewall panels 104 or in addition to being over a top edge of the sidewall panels 104.

Figure 1D:
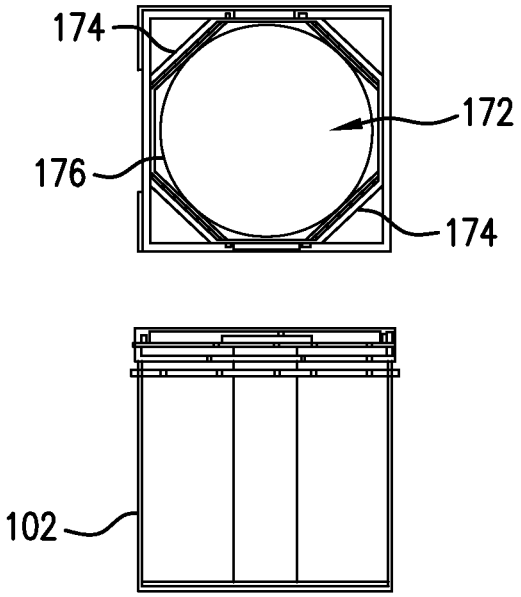
FIG. 1*d* is a top and side view of a packaging system with a round cylindrical liner according to another embodiment of the present disclosure.

In yet another embodiment of a liner having a substantially circular cross-sectional shape, sized to fit within the carton 102, as shown in FIG. 1*d*, a liner 172 may be designed to fit generally within the carton 102. The carton 102 may include additional inner side panels 174, providing an internal octagonal geometry, or other suitable polygonal geometry. The inner side panels 174 may extend substantially around the entire inner perimeter of the sidewall panels 104, or they may extend around only a portion of the inner perimeter of the sidewall panels 104, such as but not limited to, only extending across the corners of the carton sidewall panels 104. Although not necessary, the inner side panels 174, in some embodiments, may be slightly taller than the outer panels 104. The liner 172 may have a relatively smaller generally polygonal shaped rim 176, or the rim may be a substantially circular shaped rim, which may extend fully or partly around the perimeter of the liner. The octagonal inner side panels 174 at the corners of the carton sidewall panels 104 may include cutouts for the liner to pass through, thereby supporting the liner by way of the interface between the cutouts of the corner inner side panels and the substantially circular shaped rim 176.

Figure 1E:
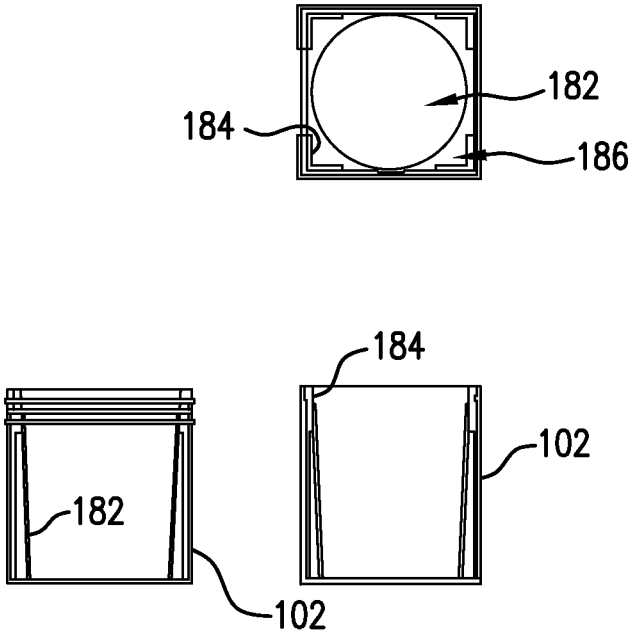
FIG. 1*e* is a top, end, and side view of a packaging system with a round cylindrical liner according to yet another embodiment of the present disclosure.

In still another embodiment of a liner having a substantially circular cross-sectional shape, sized to fit within the carton 102, as shown in FIG. 1*e*, a liner 182 may be designed to fit generally within the carton 102. The carton 102 may include additional inner side pads 184, which may be adhered to the carton sidewall panels 104, for example with adhesive. The inner side pads 184 need not be designed to extend the full height of the carton sidewall panels 104, but rather may be designed to be significantly shorter. The inner side pads 184 may extend substantially around the entire inner perimeter of the sidewall panels 104, or they may extend around only a portion of the inner perimeter of the sidewall panels 104. The liner 182 may retain a square or rectangular shaped rim 186, which may extend fully or partly around the perimeter of the liner, and may rest upon an upper edge of the inner side pads 184. The liner 182 may be positioned with the rim 186 over a top edge of the inner side pads 184 entirely within the carton sidewall panels 104 or in addition to being over a top edge of the sidewall panels 104.

Figure 1F:
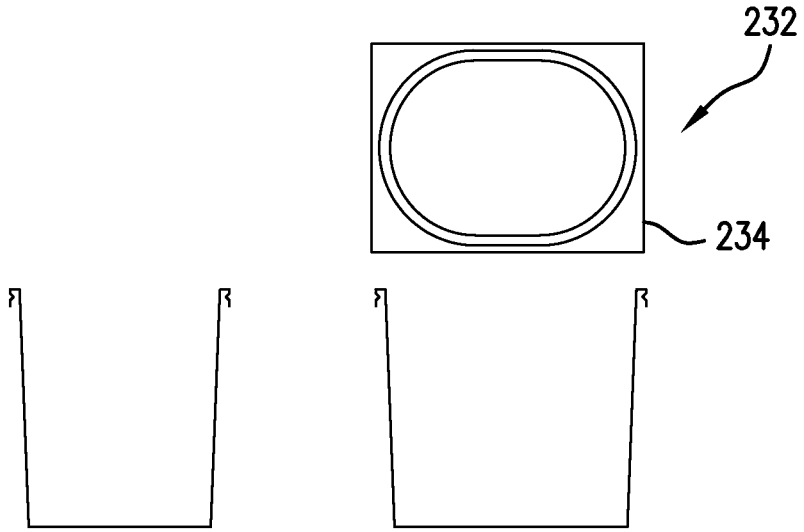
FIG. 1*f* is a top, end, and side view of a oval cylindrical liner according to one embodiment of the present disclosure.

In yet another example embodiment, as shown in FIG. 1*f*, a liner 232 may have a substantially oval cross-sectional shape, sized to fit within the carton 102. The top of the liner 232, in one embodiment, may retain a square or rectangular shaped rim 234, such that the rim may extend fully around the perimeter of the liner 232, being an integral extension of the upper end of the liner. In a further embodiment, the rim may extend partly around the perimeter of the liner.

Figure 1G:
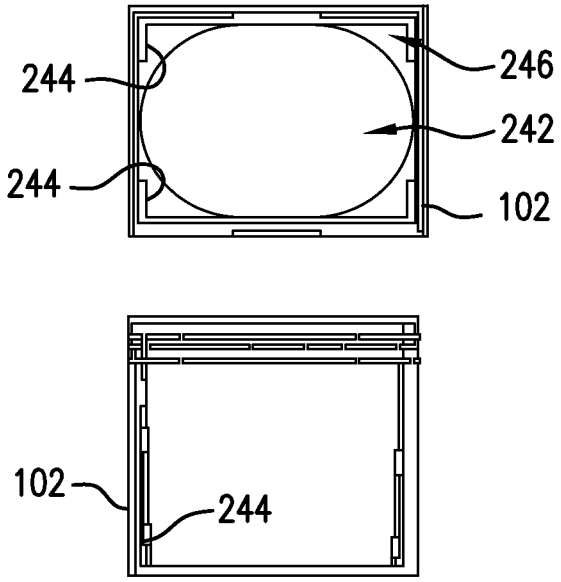
FIG. 1*g* is a top and side view of a packaging system with an oval cylindrical liner according to another embodiment of the present disclosure.

In another embodiment of a liner having a substantially oval cross-sectional shape, sized to fit within the carton 102, as shown in FIG. 1*g*, a liner 242 may be designed to fit generally within the carton 102. The carton 102 may include additional inner side panels 244. The inner side panels 164 may extend substantially around the entire inner perimeter of the sidewall panels 104, or they may extend around only a portion of the inner perimeter of the sidewall panels 104. Although not necessary, the inner side panels 244, in some embodiments, may be slightly taller than the outer panels 104. The liner 242 may retain a square or rectangular shaped rim 246, which may extend fully or partly around the perimeter of the liner, and may rest upon an upper edge of the inner side panels 244. The liner 242 may be positioned with the rim 246 over a top edge of the inner side panels 244 entirely within the carton sidewall panels 104 or in addition to being over a top edge of the sidewall panels 104.

Figure 1H:
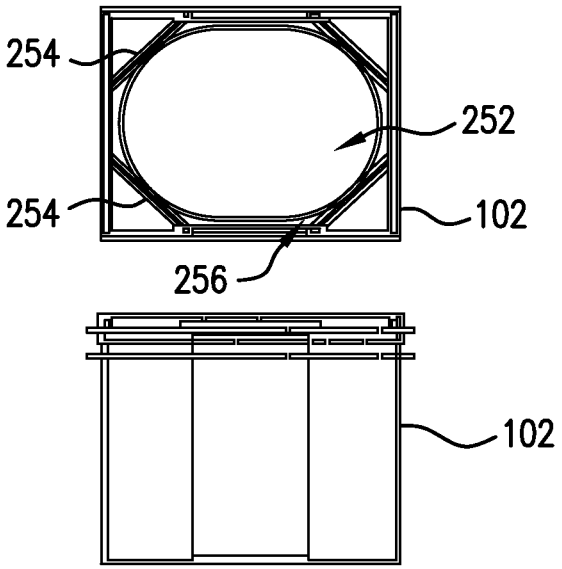
FIG. 1*h* is a top and side view of a packaging system with an oval cylindrical liner according to another embodiment of the present disclosure

In yet another embodiment of a liner having a substantially oval cross-sectional shape, sized to fit within the carton 102, as shown in FIG. 1*h*, a liner 252 may be designed to fit generally within the carton 102. The carton 102 may include additional inner side panels 254, providing an internal octagonal geometry, or other suitable polygonal geometry. The inner side panels 254 may extend substantially around the entire inner perimeter of the sidewall panels 104, or they may extend around only a portion of the inner perimeter of the sidewall panels 104, such as but not limited to, only extending across the corners of the carton sidewall panels 104. Although not necessary, the inner side panels 254, in some embodiments, may be slightly taller than the outer panels 104. The liner 252 may have a relatively smaller generally polygonal shaped rim 256, or the rim may be a substantially oval shaped rim, which may extend fully or partly around the perimeter of the liner. The octagonal inner side panels 254 at the corners of the carton sidewall panels 104 may include cutouts for the liner to pass through, thereby supporting the liner by way of the interface between the cutouts of the corner inner side panels and the substantially oval shaped rim 256.

Figure 1I:
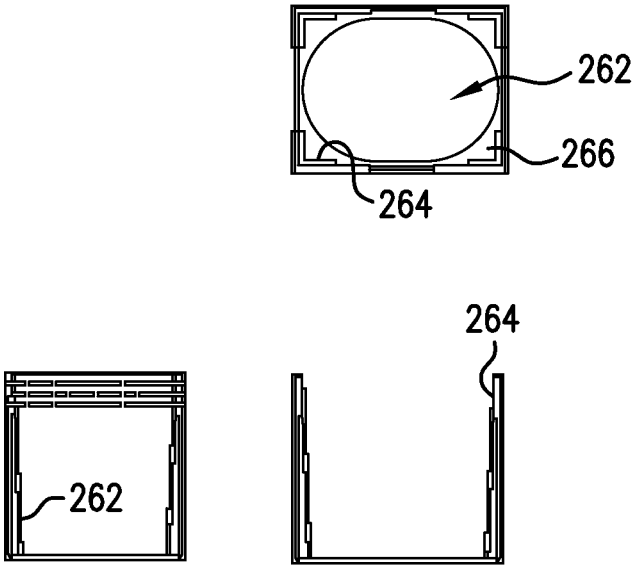
FIG. 1*i* is a top, end, and side view of a packaging system with an oval cylindrical liner according to yet another embodiment of the present disclosure

In still another embodiment of a liner having a substantially oval cross-sectional shape, sized to fit within the carton 102, as shown in FIG. 1*i*, a liner 262 may be designed to fit generally within the carton 102. The carton 102 may include additional inner side pads 264, which may be adhered to the carton sidewall panels 104. The inner side pads 264 need not be designed to extend the full height of the carton sidewall panels 104, but rather may be designed to be significantly shorter. The inner side pads 264 may extend substantially around the entire inner perimeter of the sidewall panels 104, or they may extend around only a portion of the inner perimeter of the sidewall panels 104. The liner 262 may retain a square or rectangular shaped rim 266, which may extend fully or partly around the perimeter of the liner, and may rest upon an upper edge of the inner side pads 264. The liner 262 may be positioned with the rim 266 over a top edge of the inner side pads 264 entirely within the carton sidewall panels 104 or in addition to being over a top edge of the sidewall panels 104.

Other options for supporting substantially circular or oval shaped liners within a carton having a square or rectangular cross-sectional shape are within the spirit and scope of the present disclosure. Although features may be generally described with reference herein to liner 120, it is understood that such features may also be equally applied to other liner embodiments, such as those described above.

A lidding material 140 may be sealed over the top of the liner 120 in order to contain the product within the liner 120. The lidding material 140 can be advantageous when the contents of the liner must be protected against moisture, air, bacteria, or other materials that may have a deleterious effect on the contents. The lidding material 140 may be, for example, a thin film plastic material or a thin metal foil that may be sealed to the liner 120 by any means, for example by hermetically heat-sealing the lidding material 140 to the liner 120. In other embodiments, the lidding material may be manufactured from any material suitable for sealing the liner from one or more of moisture, air, bacteria, or other materials that may have a deleterious effect on the contents. In some embodiments, the lidding material may be made of a 100% recyclable material. The lidding material may also be secured to the liner by adhesive or other methods of sealing now known or developed in the future. As can be seen in FIG. 2, the lidding material 140 may cover the entire open area 214 of the liner 120 and may be sealed to the radially extending flange 210 which runs along the perimeter of the sidewall 122 of the liner 120.

In some embodiments, a packaging system may not contain a lidding material, but may contain a plastic lid, a carton lid, or both a plastic lid and a carton lid, as will be described in detail below.

The packaging system 100 illustrated in FIG. 1A shows a plastic lid 150 that may fit over both the liner 120 and the carton 104 when the liner is placed inside the carton. FIG. 2 shows the plastic lid 150 secured over the rim 126 of the liner 120. The plastic lid 150 may be made of a resilient plastic or other suitable resilient material and be shaped to generally fit over the opening of the liner 120. By way of example but not limitation, the plastic lid may be made of the same material as the liner or some other material, and may have the same or different thickness. The plastic lid 150 may include a rim 216 that is designed to substantially interlock or otherwise removably couple with the rim 126 of the liner 120. As can best be seen in FIG. 2, the plastic lid 150 has a center portion 218 that may cover the lidding material 140 of the liner 120. In alternative embodiments, the center portion 218 or portions thereof, of the lid 150 may be eliminated. The rim 216 of the plastic lid 150 may include a skirt portion 220 that fits over, and in some cases snuggly over, the skirt portion 212 of the liner 120. The interlocking skirt portions 212, 220 of the liner 120 and plastic lid 150 may be of any configuration that permits a generally snug fit between the liner skirt portion 212 and the plastic lid skirt portion 220. In the embodiment shown in FIG. 2 the skirt portions 212, 220 are generally C-shaped, bulging outward, away from the boxing system, at the top of the skirt portion, then curving inward toward the boxing system, and then curving outward again forming a lip 213, 222 around the perimeter of both the liner and the plastic lid. However, it is recognized that any suitable interlocking or coupling mechanism or means may be used to removeably couple the lid 150 to the liner 120.

Figure 3:
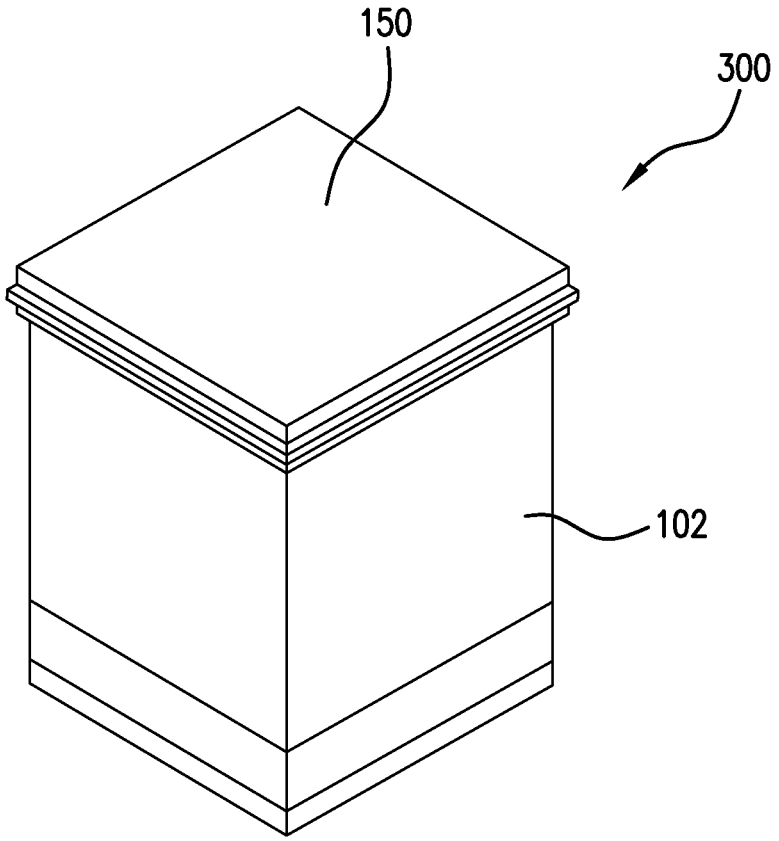
FIG. 3 is a perspective view of one embodiment of an assembled packaging system.

The plastic lid 150 may be attached to the liner 120 by pressing it down over the rim 126 of the liner 120. The pressing down action can result in the bottom end of the skirt portion 220 of the plastic lid 150 being forced outwardly far enough to snap over the skirt portion 212 of the liner 120. The inherent resilience of the plastic of which the plastic lid 150 is made can cause its rim 216 to engage, or tightly engage, with the liner rim 126 as shown in FIG. 2, thereby removeably locking the plastic lid 150 to the liner 120. The plastic lid 150 may be removed by urging it upwardly away from the liner 120, with the skirt portion 220 of the plastic lid flexing outwardly to release the plastic lid from the liner. FIG. 3 shows a carton 102 with a plastic lid 150 secured to a liner that is inside of the carton 102.

Figure 4B:
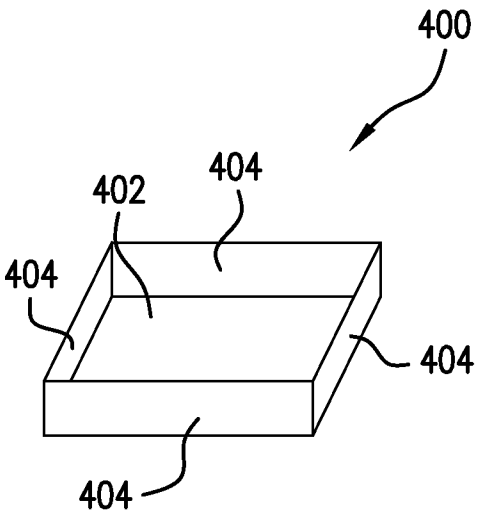
FIG. 4*b* is a perspective view of a carton lid according to one embodiment of the present disclosure.
Figure 4A:
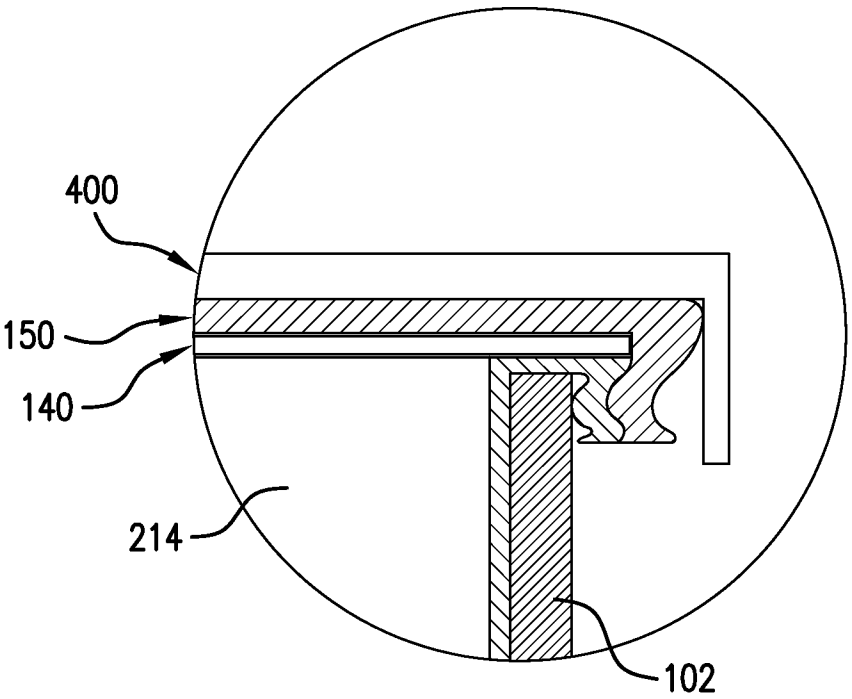
FIG. 4*a* is an enlarged fragmentary sectional view illustrating the components of a packaging system according to another embodiment of the present disclosure.

In another embodiment, the packaging system may have a carton lid in addition to or instead of a plastic lid. FIG. 4*a* shows a cross-section of an embodiment including both a plastic lid 150 and a carton lid 400. As shown in FIG. 4*b*, the carton lid 400 may be made of, for instance, corrugated cardboard and a stiff paperboard that may be 100% recyclable. By way of example, but not limitation, the carton lid 400 may be made of the same material as the carton 102 or some other material, and may have the same or different thickness. The carton lid 400 can be made to fit generally over the carton 102 and liner 120. FIG. 4*b* illustrates a carton lid 400 with an inner portion 402 and four side walls 404. The carton lid 400 can have substantially the same shaped cross-section as the carton it will cover, except that the carton lid may be slightly bigger than the carton so that the carton lid may fit over, and in some cases securely over, the carton 102 and the liner 120. Thus, like the carton itself, the carton lid may be either square-shaped or rectangular-shaped.

In a further embodiment, as shown in FIG. 4*c*, a carton lid 410 may be generally integral with the carton 102 and at least partially separable from the carton along a corrugated tear strip, pull string, or perforation 412. Although not required, this type of carton lid may be preferably used with embodiments of liners that fit entirely within the sidewall panels 104 of the carton. The tear strip 412 may be removed (or the pull string can be pulled, or the perforated line separated) so as to allow the carton lid 410 to at least partially separate from the carton 102. In some embodiments, the tear strip 412 may extend entirely around the carton 102, so as to allow the carton lid 410 to be fully removed from the carton to expose the liner within. In other embodiments, the tear strip 412 may extend only partially around, for example around three sides of the carton, so as to allow the carton lid 410 to be partially removed from the carton to expose the liner within, as shown in FIG. 4*c*. In either embodiment, the carton lid 410 may be reusable to reseal or re-cover the carton once access to the liner within is no longer desired. In further embodiments, the tear strip 412 may be located at any suitable position to allow a portion of the carton to open for access to the liner within.

In still another embodiment, the carton lid may be generally integral with the carton 102 and comprise one or more flaps, which may be folded over the carton opening to close the carton. The flaps may also include one or more tear strips to secure the flaps in a closed position until the carton is opened for the first time.

At any rate, in some embodiments the packaging system may include a carton 102, a liner 120, a lidding material 140, and a carton lid 400 without a plastic lid 150. In yet another embodiment the packaging system may include a carton 102, a liner 120, a plastic lid 150, and a carton lid 400 without a lidding material. In any event, the packaging system may be designed to include one, two, or each of the lidding material 140, plastic lid 150, and carton lid 400. For example, in some embodiments, the packaging system may include only the lidding material 140 without a plastic lid 150 or carton lid 400.

Figure 5C:
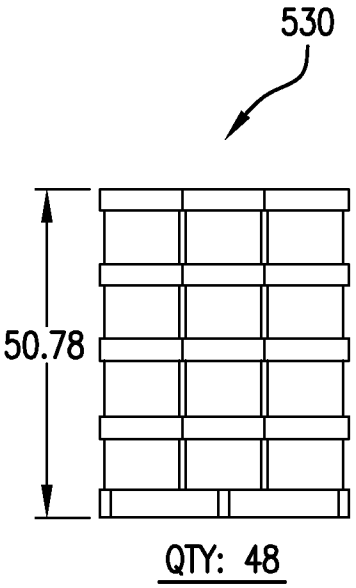
FIG. 5*c* is a perspective view of an embodiment of the present disclosure skidded on a pallet with 48 packaging assemblies.
Figure 5B:
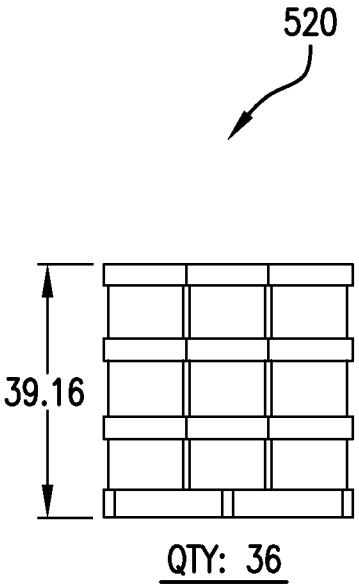
FIG. 5*b* is a perspective view of an embodiment of the present disclosure skidded on a pallet with 36 packaging assemblies.
Figure 5A:
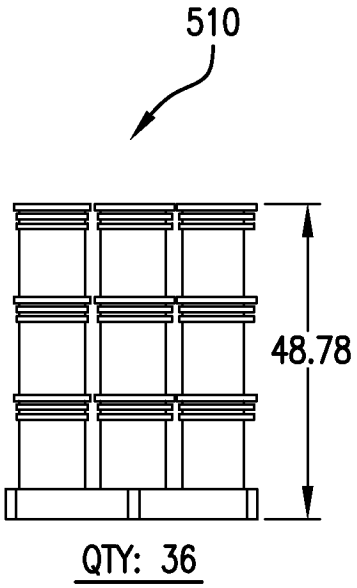
FIG. 5*a* is a perspective view of traditional packing buckets skidded on a pallet.

Because traditional pails or buckets that are used to ship viscous materials are typically cylindrical, a significant amount of space may be wasted during shipping because one bucket cannot line up directly next to another bucket as can be seen in FIG. 5*a*. Further, because traditional pails are so thick, each bucket takes up more space, and in some cases significantly more space, than the packaging system of the present disclosure. This can best be seen in FIGS. 5*a* and 5*b* which show how the same quantity of product would be skidded in the present disclosure 520 and in the traditional bucket system 510. As can been seen, each skid 510, 520 contains 36 units, however, the height of the skidded present disclosure 520 is considerably less than the height of the skidded traditional bucket 510. In fact, adding another layer of the packaging system of the present disclosure to the skid 520 may only increase the height of the skid by a small amount, such as a couple inches, compared to the traditional bucket system 510 as shown in FIGS. 5*a* and 5*c*. Adding this additional layer can result in more product per skid, and in some cases up to 33% or more product. In addition to being able to store and/or ship more, and in some cases significantly more, product by means of the present disclosure, the same quantity of product weighs less, and in some cases significantly less, when packaged using the present disclosure rather than the traditional buckets. This may make product packaged using the present disclosure easier to move, and in some cases less costly to ship.

In practice, the liner of the present disclosure may be filled with a liquid, viscous material or particulate material before the liner is placed in the carton, or while the liner is in the carton. In existing conventional packaging systems, a liner might also be filled before being placed inside a box, or after being placed in a box. However, if a sealing member was going to be applied to the liner, the liner would have to be filled before being placed in the box. In that case, a sleeve or support member would need to be placed around the liner to stabilize the liner. Alternately, in conventional packaging systems, the liner could be placed inside the box and then filled with material, but in that case, the liner could not be sealed with a lidding material. One such existing packaging system is described in U.S. Pat. No. 6,892,933, the entirety of which is hereby incorporated by reference herein. One novel and advantageous aspect of some embodiments of the present disclosure, however, is that the liner may be filled when it is in the carton, and the lidding material may be sealed to the liner after the liner has been filled, and while the liner is still in the carton.

Figure 6:
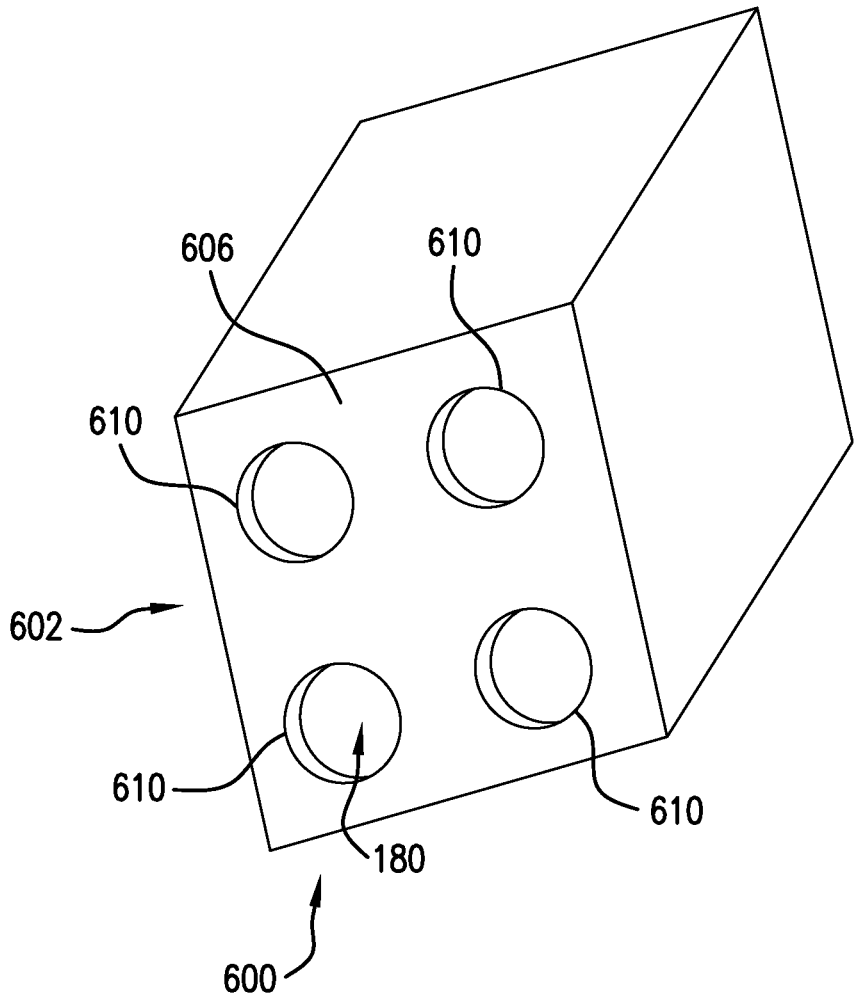
FIG. 6 is a perspective view of the bottom wall of a carton with four round liner access points, according to one embodiment of the present disclosure.

A further embodiment of the present disclosure illustrated in FIG. 6 shows the bottom wall 606 of a carton 602. In this embodiment, the bottom wall 606 may contain liner access points 610. While four liner access points 610 are shown, it is recognized that fewer or greater liner access points 610 may be used as suitable or desirable for the intended application. In the embodiment shown, the liner access points 610 are round, but they may be any shape, such as but not limited to square, rectangular, triangular, oblong, etc. The liner access points 610 are areas that are cut out or otherwise removed from the bottom wall 602 creating openings in the bottom wall 602, such that when the liner 120 is inside the carton 602, the liner may be accessed and pushed up from the bottom of the carton 602. During the packing process, the liner 120 may be placed in the carton 602 in order to fill the liner 120 with material. Prior to sealing the lidding material 140 on the liner 120, the liner 120 may be pushed up, for example, approximately ½ inch to 1½ inches, or any other suitable amount, in order to seal the lidding material 140 on the liner 120. The liner 120 may be raised for sealing by pushing up on the liner 120 through the liner access points 610 in the bottom wall 606 of the carton 602.

In some embodiments, a liner pad 180, as shown in FIGS. 1 and 6, may be removeably placed inside of the carton 602 prior to placing the liner in the carton. The pad 180 may rest between the bottom wall 606 of the carton 602 and the bottom of the liner. When the liner is pushed up for sealing through the liner access points 610, the pad 180 may equalize the pressure applied to the liner and help stabilize the liner, allowing the filled liner to keep its shape as it is pushed upward. The pad 180 may be made of corrugated cardboard. In other embodiments, the pad may be made of another paper material, plastic, wood, metal, or any other suitable material, or combination of materials. In one embodiment, the pad 180 may be of any desirable thickness. For instance, a relatively thin pad may be used with liners that are not intended to be very heavy when filled, whereas a thicker pad may be desirable when the filled liner is expected to be heavy. In other embodiments, a pad may not be used at all. In some embodiments, the pad 180 may be square or rectangular in shape and sized to fit snuggly within the perimeter of the square or rectangular panels 104 of the sidewall of the carton 602. In alternative embodiments, the pad 180 may be shaped other than as a square or rectangular, such as but not limited to circular, triangular, ovoid, etc. Similarly, the pad 180 need not be sized to fit snuggly within the perimeter of the square or rectangular panels 104 of the sidewall of the carton 602, and in some embodiments the pad 180 may be sized such that the pad 180 covers at least a portion of one or more of the liner access points 610. Liner access points and liner pads may be suitably used with any liner of the present disclosure, and may further be applied to existing packaging system, such as but not limited to, those described in U.S. Pat. No. 6,892,933, which was previously incorporated by reference herein.

Once the filled liner has been covered with a lidding material, a plastic lid may be applied to the liner. Additionally, a carton lid may cover the plastic lid. In other embodiments, as mentioned previously, only a carton lid may cover the lidding material of the liner. The packaging system may then be shrink-wrapped or banded for skidding and shipping.

Figure 7:
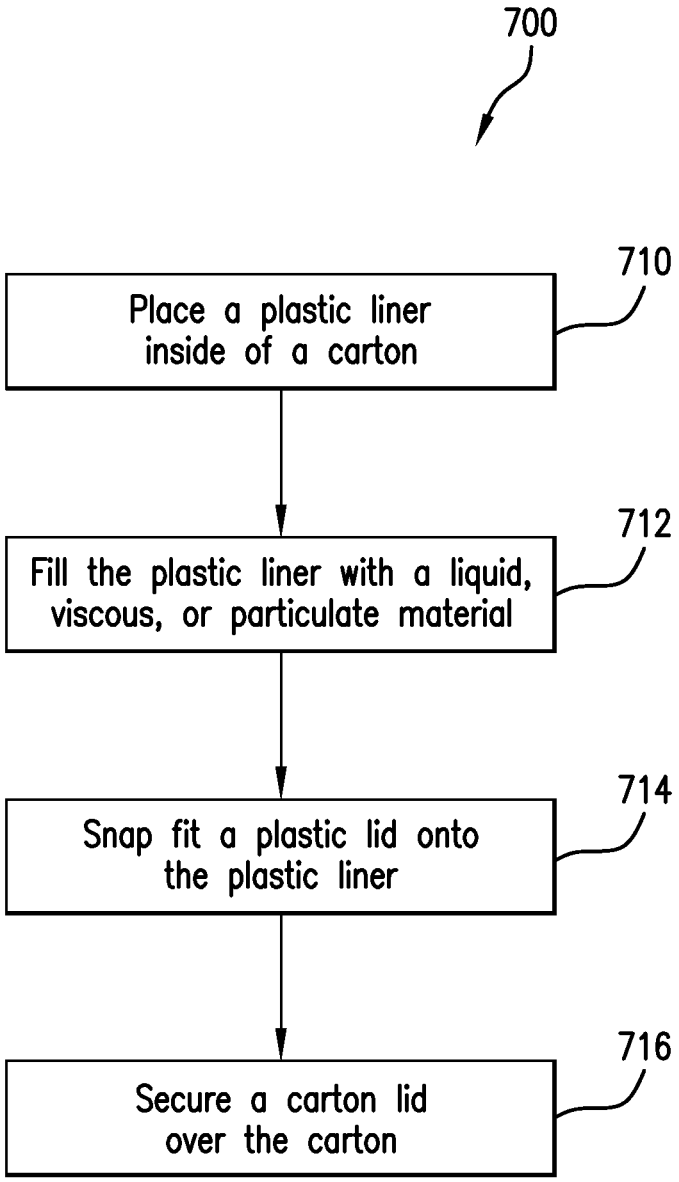
FIG. 7 is a flow diagram illustrating a method for packaging and holding liquid, viscous, and particulate materials, according to one embodiment of the present disclosure.

A further embodiment of the present disclosure is a method for packaging and holding liquids, viscous, or particulate materials as illustrated in FIG. 7. In one embodiment, a plastic liner may be placed inside of a carton 710, either with the rim of the liner extending over the top edge of the carton or positioned entirely within the exterior walls of the carton. Once the liner is inside of the carton, the liner may be filled with a liquid, viscous, or particulate material, or any combination thereof 712. After the liner has been filled, in some embodiments, a plastic lid may be snap fit onto the plastic liner to secure the contents of the liner within 714. In some embodiments a carton lid may be secured over the plastic lid. 716.

In another embodiment of the present disclosure, a lidding material is affixed to the plastic liner after the plastic liner has been filled with product. In some embodiments, the affixing of the lidding material may be facilitated by pushing the plastic liner up and away from the carton so as to more easily access and seal the lidding material onto the rim of the plastic liner. The plastic liner may be pushed up through liner access points in the bottom of the carton, as described above.

Another advantage of the present disclosure is that the system may be integrated into already existing single and multi-head filling lines. Furthermore, the carton 102 may be assembled using standard equipment. The liner 120 may be installed, and the carton 102 and liner 120 may be conveyed to the existing filler. Once the liner 120 has been filled with product, a lidding material 140 may be heat sealed in place to protect the product. A plastic lid 150 may, or may not be, installed over the liner 120. A secondary or tertiary carton lid 400 may, or may not be, installed over the packaging system to protect the package during shipping. Then the packaging system may be shrink-wrapped or banded for skidding and shipping.

Figure 8:
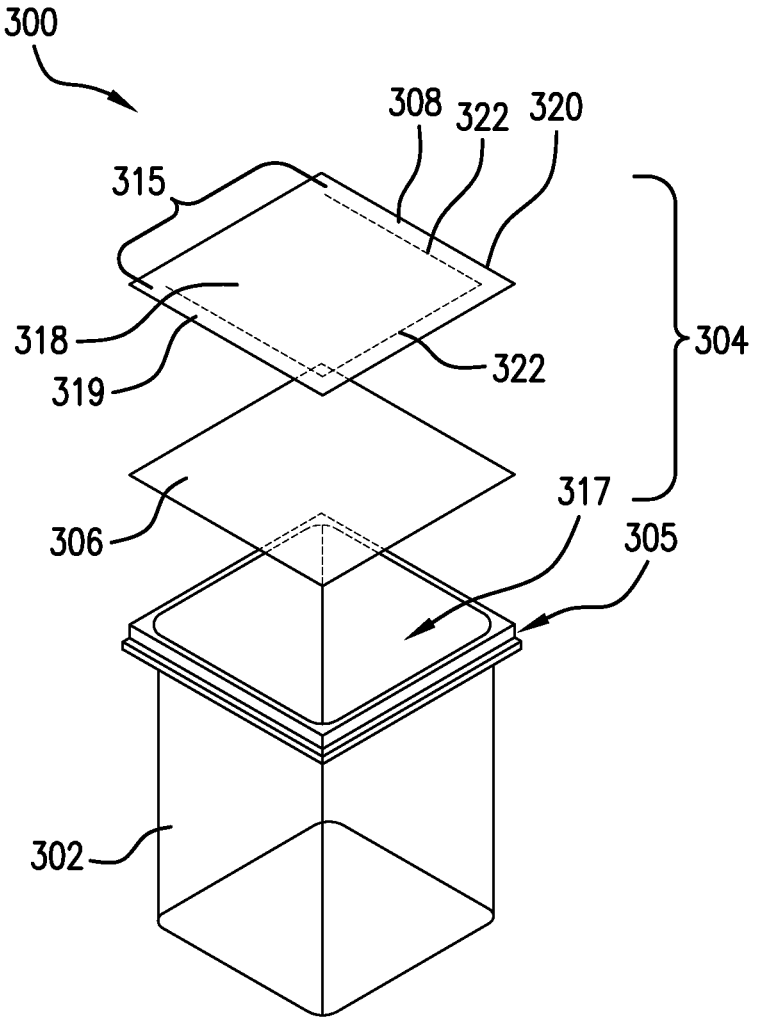
FIG. 8 is an exploded perspective view of the components of a packaging system according to one embodiment of the present disclosure.
Figure 9:
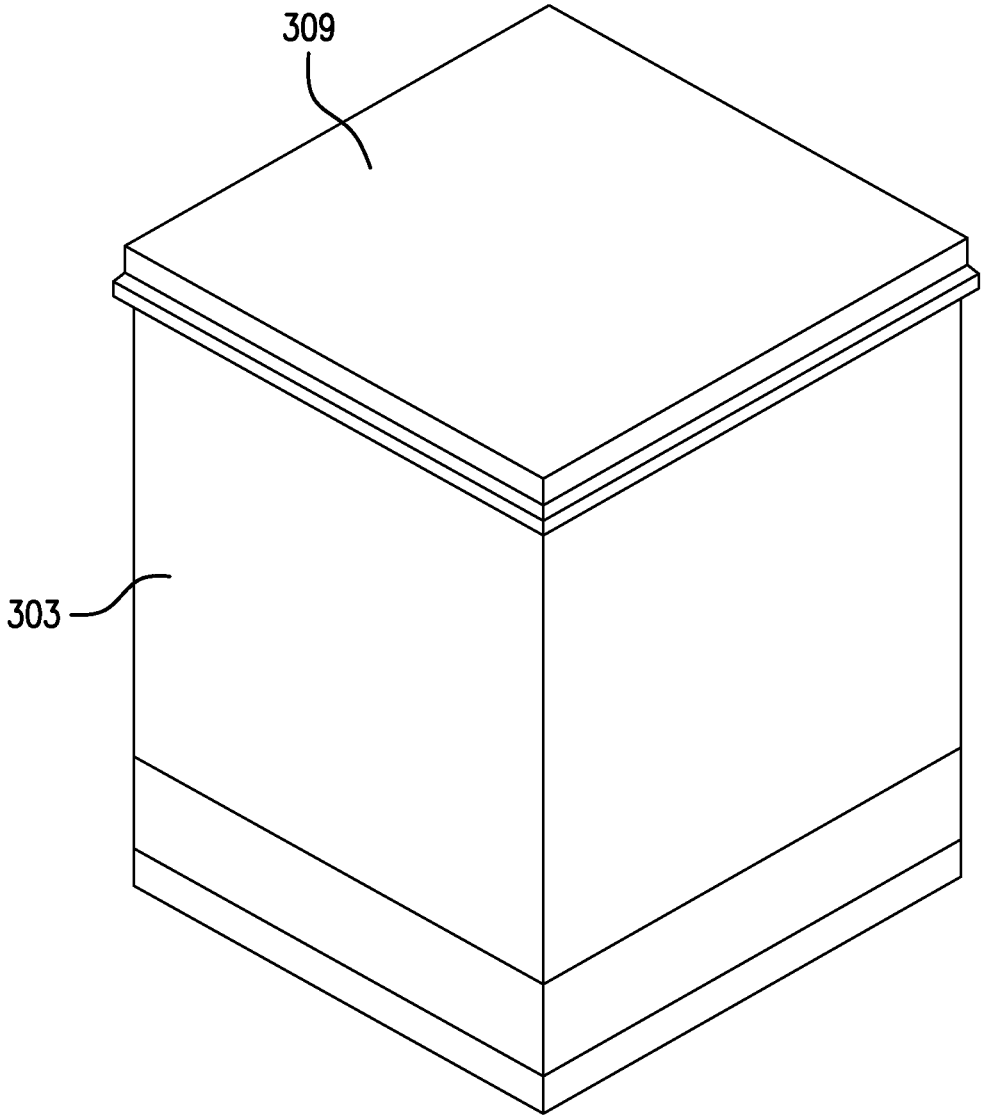
FIG. 9 is a perspective view of one embodiment of the assembled packaging system of FIG. 8.
Figure 10:
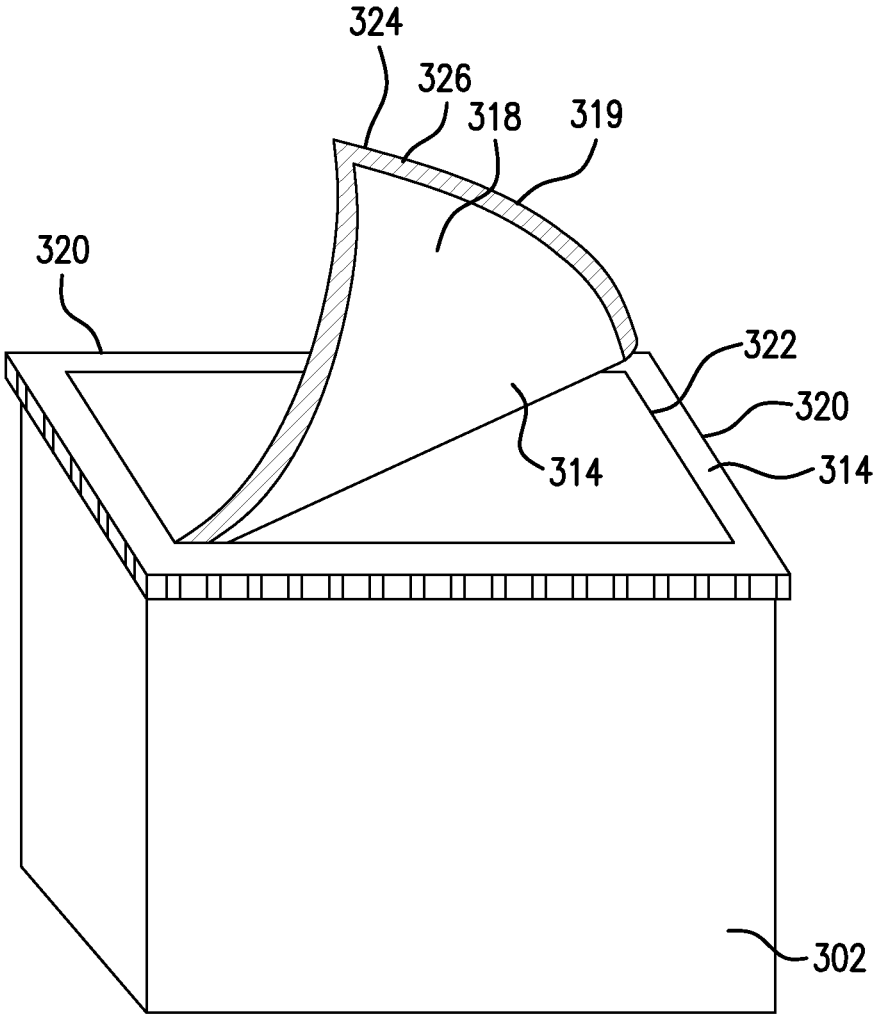
FIG. 10 is a partially opened packaging system according to one embodiment of the present disclosure.

FIGS. 8-10 illustrate another exemplary embodiment of the packaging system 300 in which the plastic liner 302 has a peel and reseal lidding assembly 304. It is appreciated that the packaging system 300 shown and described in FIGS. 8-10 can include the features described in the other embodiments described herein. For example, the packaging system 300 can include a carton 303, plastic liner 302 having a rim 305, plastic lid 309, and carton lid (not shown).

As illustrated in FIG. 8, the peel and reseal lidding assembly 304 includes a lidding material 306 and a peel-reseal lidding material 308. The lidding material 306 may be similar to or include features of the lidding material 140 described above. Preferably the lidding material 306 is sealed to the plastic liner 302 and covers the entire open area 317 of the liner 302.

The lidding material 306 may be hermetically heat sealed or laminated to the plastic liner 300 such as described above. To access the contents within the plastic liner 302, the lidding material 306 can be broken, torn, or pierced through. Preferably, the lidding material 306 can be broken, torn, or pierced through using a sharp object such as a knife, scissors, or the like. In some configurations, an indicator or marking can be provided instructing a user the preferred area to cut.

Preferably, when the lidding material 306 is sealed to the plastic liner 302, the packaging system 300 has sufficient strength and rigidity such that it passes the appropriate shipping tests under the International Safe Transit Association ("ISTA"). In particular, the sealed packaging system 300 preferably has sufficient strength and rigidity to pass the ISTA-3E shipping test or an equivalent test that challenges the capability of the packaging system and contents therein to withstand transport hazards. The lidding material 306 also preferably acts as a tamper-evident system and can indicate to the user that the packaging system 300 has been tampered with if the lidding material 306 is broken.

Preferably, the peel-reseal lidding material 308 is heat sealed along its edges 320 to the lidding material 306 and/or plastic liner 302. The peel-reseal lidding material 308 includes at least a first layer 314 and a second layer 324, such as a sealing layer, that are generally coextensive and adhered to each other. In the preferred embodiment, the second layer 324 is permanently affixed to the first layer 314 and the first layer 314 is positioned so that it faces the interior of the plastic liner 302. The first layer 314 and second layer 324 can be of substantially the same size or in some configurations, the second layer 324 can be smaller than the first layer 314. In the embodiment illustrated in FIG. 8, the liner 302 is substantially rectangular and the lidding material 308 has four edges 320 corresponding to the geometry of the opening of the liner 302. It will be appreciated that other liner geometries can be used, for example and without limitation, the opening of the liner 302 could be circular, or polygonal with more or less than four sides. The first layer 314 includes a center portion 318 and a remaining area 319 adjacent the center portion 318. The center portion 318 is positioned at a predetermined distance from the edge 320 of the peel-reseal lidding material 308.

The center portion 318 is defined by four edges, in which at least three of the edges are detached edges 322. The detached edges 322 are preferably perforated or a pre-torn slit that separates the three edges of the center portion 318 from the remaining area 319 of the first layer 314. The fourth or remaining edge of the center portion 318 is preferably affixed to the remaining area 319 to act as a hinge 315 so that the center portion 318 can be pulled back to expose the lidding material 306 thereunder. The center portion 318 of the peel-reseal lidding material 308 can then be resealed to seal the open area 317 of the plastic liner 302 when the lidding material 306 has been broken.

The second layer 324 preferably includes an adhesive portion 326 that extends beyond the sides of the center portion 318 (as shown in FIG. 10). The adhesive portion 326 includes a resealable adhesive 310 on the bottom surface of the adhesive portion 326 facing the interior of the plastic lid 302. As the user pulls back the center portion 318, the adhesive portion 326 is also pulled back with the center portion 318. The adhesive portion 326 is preferably includes a resealable adhesive material that can seal and resealed multiple times to facilitate resealing the center portion 318 against the peel-reseal lidding material 308, for example, against the portion of the first layer 314 adjacent the center portion 318 and edge 320.

Preferably, the first layer 314 is preferably made of a metallized material or structure, such as polyethylene terephthalate, mono-oriented polypropylene film, or COEX NYL/PE or a combination thereof that acts as an oxygen and moisture barrier. The metallized structure also has sufficient hot tack and seal strength such that the packaging system 300 is suitable for packaging both hot and cold materials. The first layer 314 can also be made of an opaque material to reduce the amount of light that enters the interior of the plastic liner 302. In some embodiment, the first layer 314 can be made of material that reflects or reduces ultraviolet light exposure.

In the preferred embodiment, the peel-reseal lidding material 308 includes a tab 312 that is not adhered to the lidding material 306 such that a user can easily grasp the tab 312 and pull back the center area 318 of the peel-reseal lidding material 308 from the lidding material 306. In some configurations, the tab can be a portion of either the first 314 or second layer 324. In yet other configurations, no tab can be provided.

Figure 11:
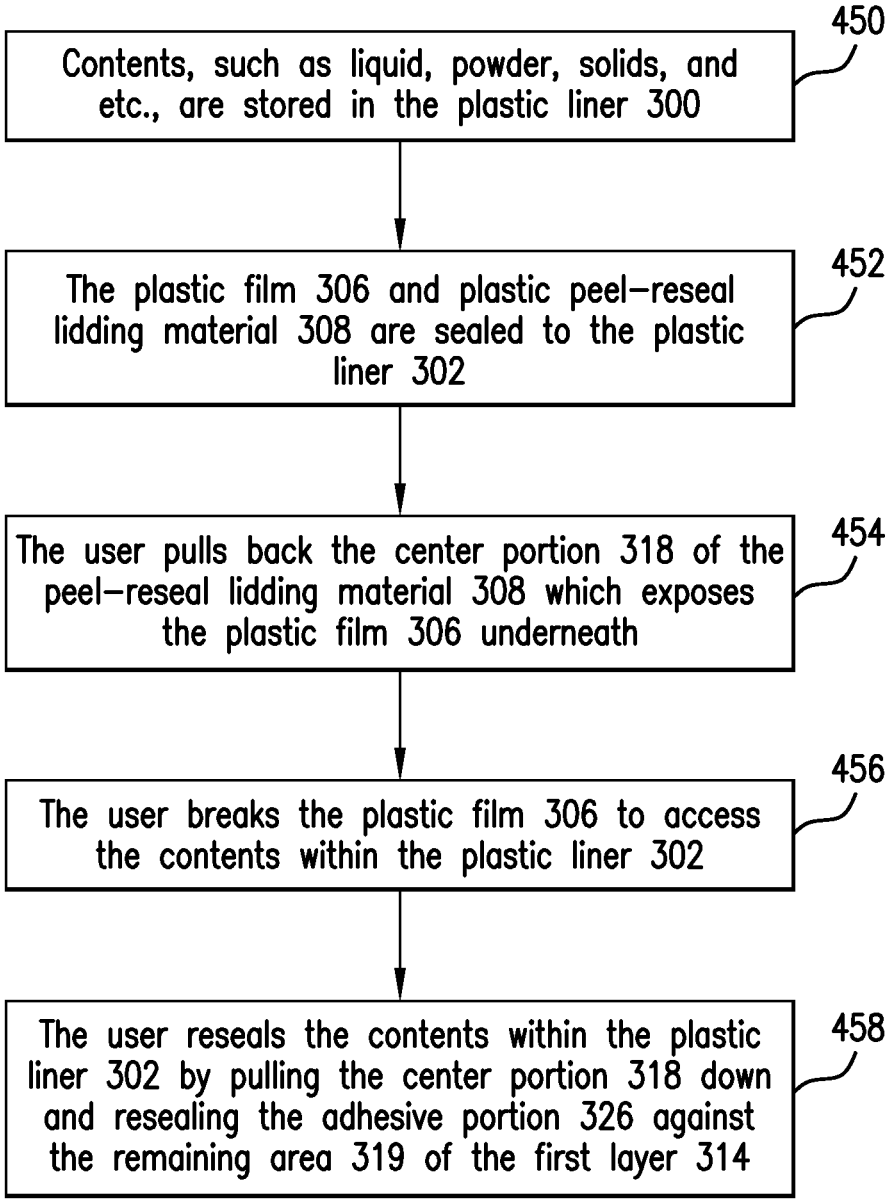
FIG. 11 is an exemplary flow diagram illustrating a method of using a packaging system according to one embodiment of the present disclosure.

FIG. 11 illustrates an exemplary method of using the packing system 300 shown in FIGS. 8-10. Contents, such as liquid, powder, solids, and etc., are stored in the plastic liner 300 (step 450). The lidding material 306 and peel-reseal lidding material 208 are heat sealed to the plastic liner 302 (step 452). As shown in FIG. 9, the plastic liner 300 can be optionally stored within a carton 303 with a plastic lid 309 and/or carton lid (not shown). The packaging system 300 is then transported, such as by ground or air transportation, to the user. Once received, the user can access the contents stored within the plastic liner 300 by first removing, if necessary, the plastic lid 309 and/or carton lid (not shown). The user then pulls back the center portion 318 of the peel-reseal lidding material 308 which exposes the lidding material 306 underneath (step 454). For configurations in which the peel-reseal lidding material 308 includes a tab 312, the user can grasp the tab 312 using, for example, their fingers to facilitate opening the peel-reseal lidding material 308. The user breaks the lidding material 306 to access the contents within the plastic liner 302 (step 456). The user then reseals the contents within the plastic liner 302 by pulling the center portion 318 toward the plastic liner 302 and resealing the adhesive portion 326 against the remaining area 319 of the first layer 314 (step 458). Optionally, the plastic lid 309 and/or carton lid can be placed over the plastic liner 302.

By having a plastic liner 302 with a peel reseal lidding assembly 304, the contents within the plastic liner 302 can be sufficiently secured and protected during transportation. Further, because the opening of the plastic liner 302 can be resealed, the packaging system 300 can be used to store the contents even after the packaging system 300 has been opened. This saves the additional cost of storing the contents in separate containers.

Alternatively, the second layer can be a strip of adhesive having a width less than that of the center portion 318 and with one side affixed to the center portion 318 and a second side extending from the sides of the center portion 318 and having the resealable adhesive. In the foregoing description various embodiments of the present disclosure have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

FIGS. 12-14D illustrate another exemplary embodiment of the packaging system 1000 in which the plastic liner 1050 has a peel and reseal lidding assembly 1040. It is appreciated that the packaging system 1000 shown and described in FIGS. 12-14 can include one or more of the features in any combination described in the other embodiments described herein, or the packaging system can include none of the previously described features. For example, the packaging system 1000 can include any combination of a carton 1002, plastic liner 1050 having a rim 1005 peel and reseal lidding assembly 1040, and carton lid 1060.

Figure 12:
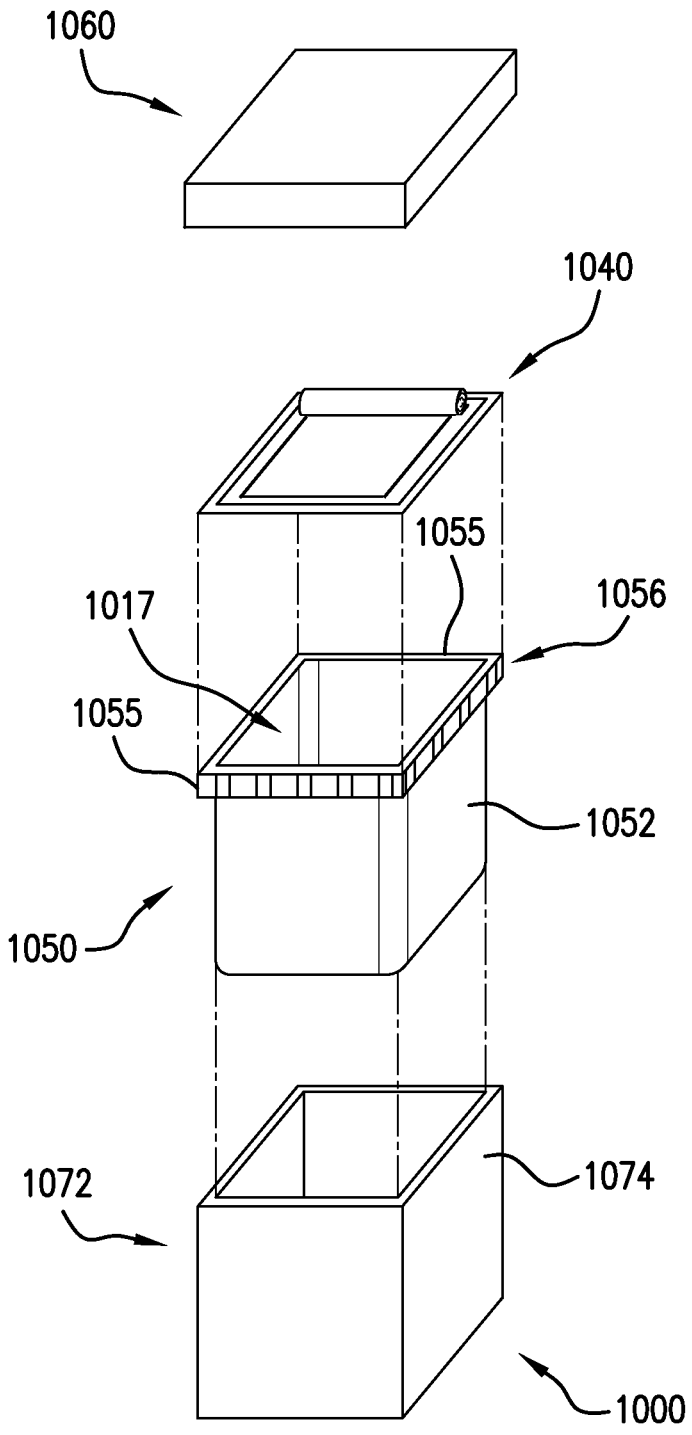
FIG. 12 is a perspective assembly view of a packaging system, according to one embodiment of the present disclosure.

As illustrated in FIG. 12, carton 1072 having side walls 1074 may receive the liner 1050. The flange and bottom wall of the liner 1050 may support the liner 1050 in the carton 1072. A peel and reseal lidding assembly may be attached to the liner 1050 on the flange 1055. A carton lid 1060 may include the liner 1050 and the peel and reseal lidding assembly within.

Figure 13A:
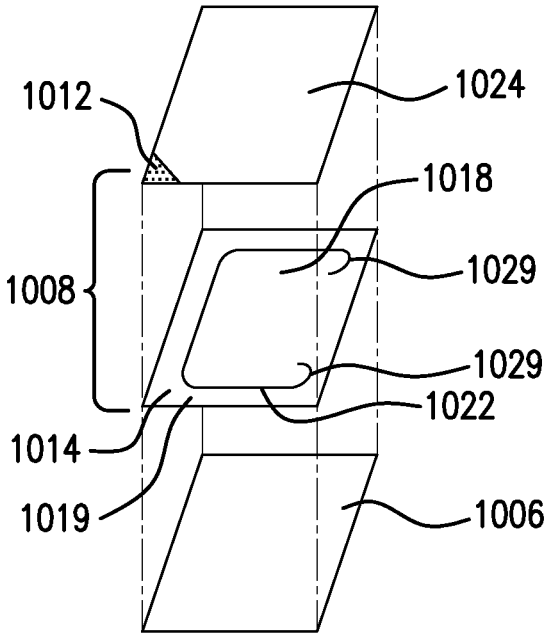
FIG. 13A is a perspective view of the lidding material, according to one embodiment of the present disclosure.

As illustrated in FIG. 13A, the peel and reseal lidding assembly 1040 may include a plurality of layers. For example, the peel and reseal lidding assembly 1040 may include a lidding material 1006 and a peel-reseal lidding material 1008. The lidding material 1006 may be similar to or include features of the lidding material 140 or 340 described above. The lidding material 1006 may be sealed to the plastic liner 1050 and cover the entire open area 1017 of the liner 1050. The lidding material 1006 may be a clear layer or an opaque layer or a translucent layer. The lidding material 1006 may be any suitable material used in the applicable industry. For example, coextruded nylon may be used. The lidding material 1006 may have a thickness from 1-20 Mils. In one example, the lidding material may have a thickness of 4 Mils which, when paired with peel-reseal lidding material 1008, the peel and reseal lidding assembly 1040 may have a suitable rigidity and flexibility. For example, the lidding material 1008 may be sufficiently flexible to be folded over on itself or rolled-up into a roll while open. The lidding material 1008 may be sufficiently rigid to not fall into the opening under its own weight. The lidding material 1006 may be hermetically heat-sealed or laminated to the plastic liner 1050 such as described above.

The peel-reseal lidding material 1008 may comprise a first layer 1014 and a second layer 1024. One layer may be a layer operable to reseal an open container. One layer may be a stiffening layer. The stiffing layer may be operable to limit the peel-reseal lidding material 1008 from folding over on itself under its own weight or small forces. The second layer may remain attached to at least a portion of the first layer. For example there may be multiple portions of the first layer as discussed below. The second layer may detachably connect to one portion of the first layer but remain attached to another portion as the first layer is open and closed along its opening.

The first layer may be any material that provides support to lidding material 1006 or that provides a suitable oxygen barrier. For example, the first layer 1014 may be a metallized oriented polypropylene (MOPP) layer. Metallized films are polymer films coated with a thin layer of metal, usually aluminum. They offer the glossy metallic appearance of an aluminum foil at a reduced weight and cost. Metallized films are widely used for decorative purposes and food packaging. Metallization is performed using a physical vapor deposition process. Aluminum may be a typical metal used for deposition, but other metals such as nickel or chromium are also used. The metal is heated and evaporated under vacuum. This condenses on the cold polymer film, which is unwound near the metal vapor source. This coating is much thinner than a metal foil (although a metal foil may also be used in various embodiments) could be made, in accordance with various embodiments in the range of 40 ga to 100 ga. For example, the first layer may be about 70 ga MOPP. In various embodiments, either polypropylene, nylon, polyethylene, cast polypropylene and polyethylene terephthalate (PET) may be used with metallization.

In accordance with various embodiments, the second layer may be formed from similar material as the first layer. However, the second layer may be formed without metallization. The second layer 1024 may hold the first layer 1014 closed with an adhesive applied to one side. Like the first layer, the second layer may be formed from polypropylene, nylon, polyethylene, cast polypropylene and polyethylene terephthalate (PET). The second layer may be formed from a variety of thicknesses such as 30 ga to 90 ga. For example, the second layer 1024 may be formed of about 50 ga PET.

In accordance with various embodiments, the peel and reseal lidding assembly 1040 may be comprised of a stack of the second layer 1024 being 48 ga PET with ink applied to nonstick areas (such as pull tab, see below) and with an adhesive applied to one side, the first layer 1014 being a 70 ga Metallized OPP with an adhesive on both sides, and a lidding material 1006 being a 4Mil COEX nylon film adhered to one side of the first layer. This embodiment and similar embodiments may be used to package hot and cold materials. The assembly may have excellent hot tack and seal strength. The Metallized Structure gives the assembly improved oxygen and moisture barrier and good rigidity while maintaining some flexibility in order to keep the center portion 1018 (discussed in more detail below) moveable for opening.

Figure 13F:
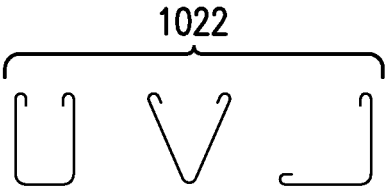
FIG. 13F is schematic of various detached edge profiles, according to one embodiment of the present disclosure.
Figure 13B:
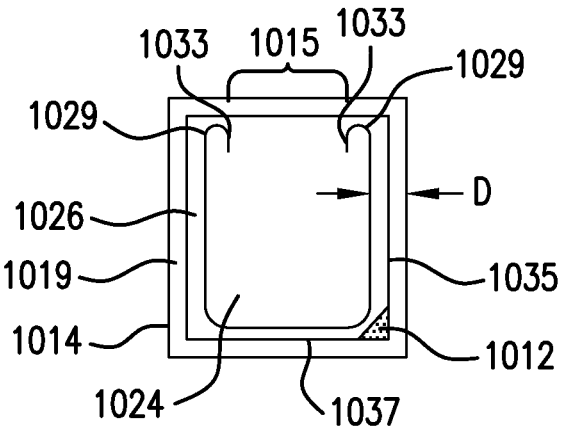
FIG. 13B is a top view of the lidding material in a closed position, according to one embodiment of the present disclosure.
Figure 13G:
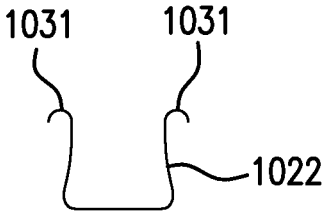
FIG. 13G is schematic of edge terminations, according to one embodiment of the present disclosure.
Figure 13C:
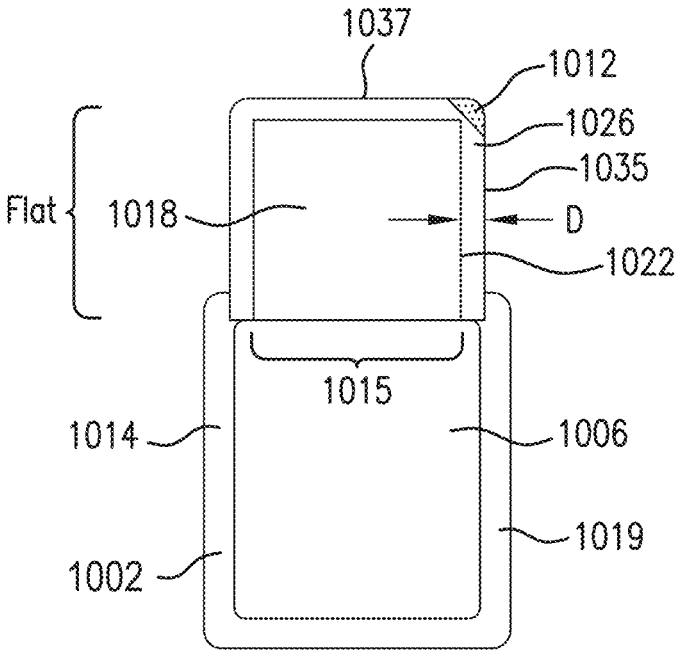
FIG. 13C is a top view of the lidding material in an open position, according to one embodiment of the present disclosure.
Figure 13D:
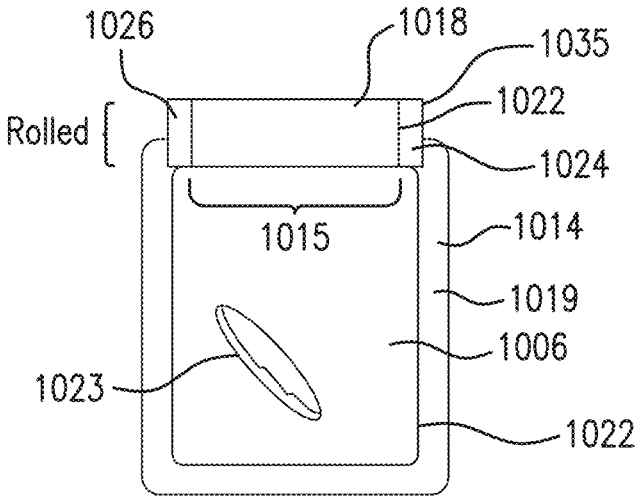
FIG. 13D is a top view of the lidding material in a rolled open position, according to one embodiment of the present disclosure.
Figure 13E:
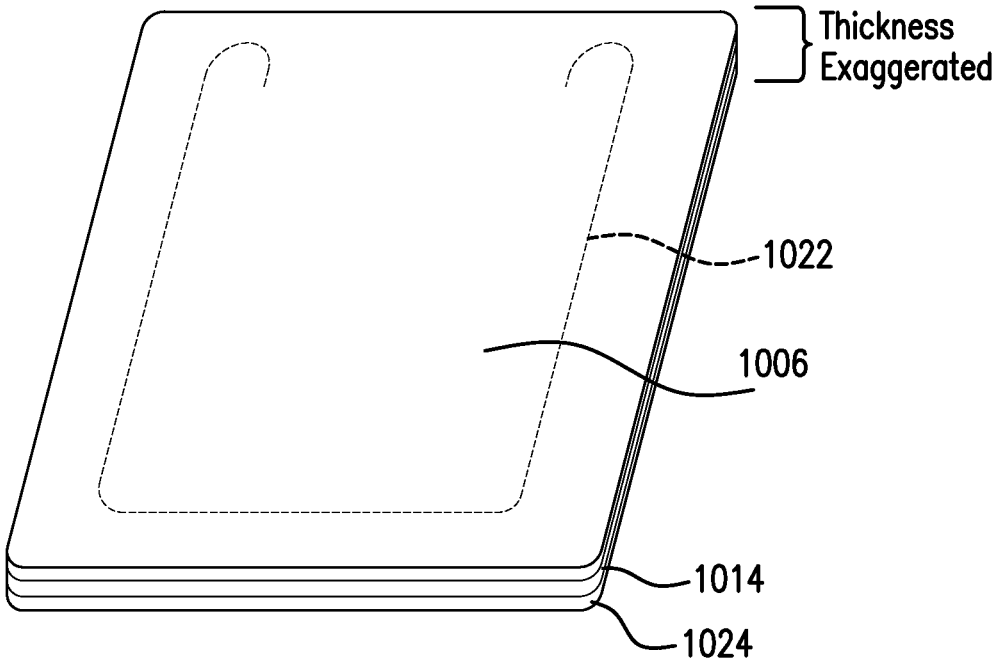
FIG. 13E is a bottom perspective view of the lidding material, according to one embodiment of the present disclosure.
Figure 14A:
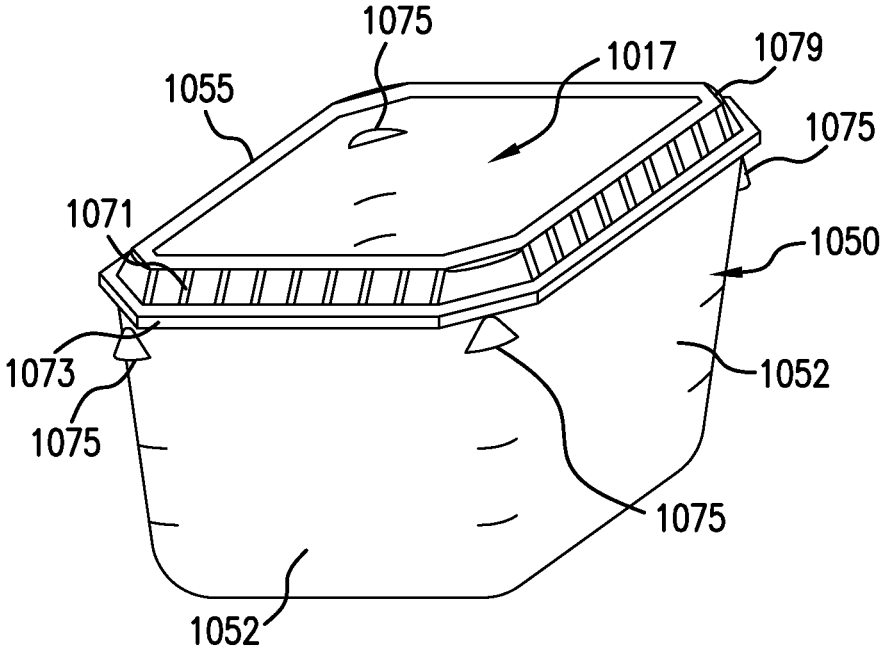
FIG. 14A is a perspective view of the liner, according to one embodiment of the present disclosure.
Figure 14B:
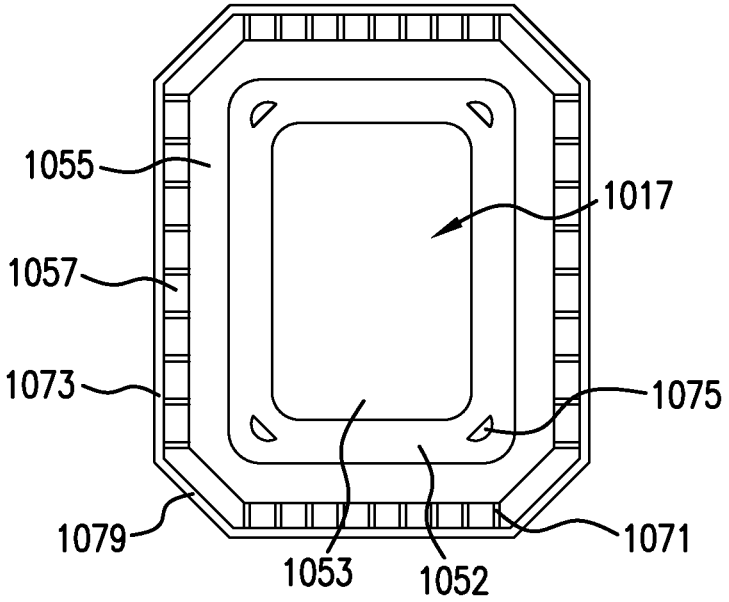
FIG. 14B is a top view of the liner, according to one embodiment of the present disclosure.
Figure 14C:
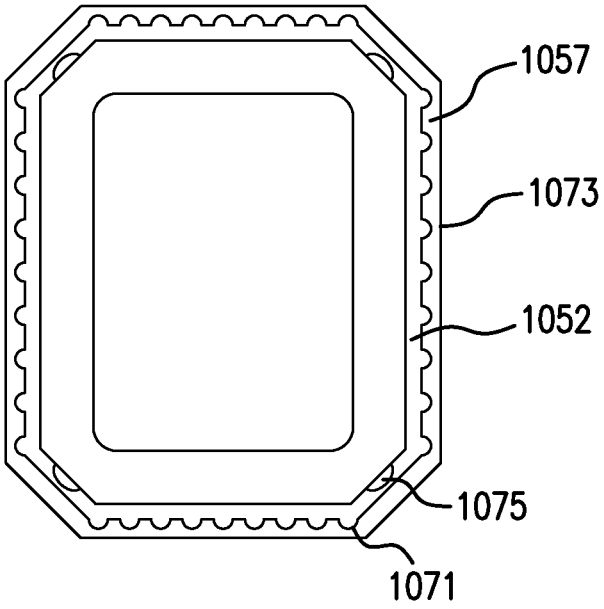
FIG. 14C is a bottom view of the liner, according to one embodiment of the present disclosure.
Figure 14D:
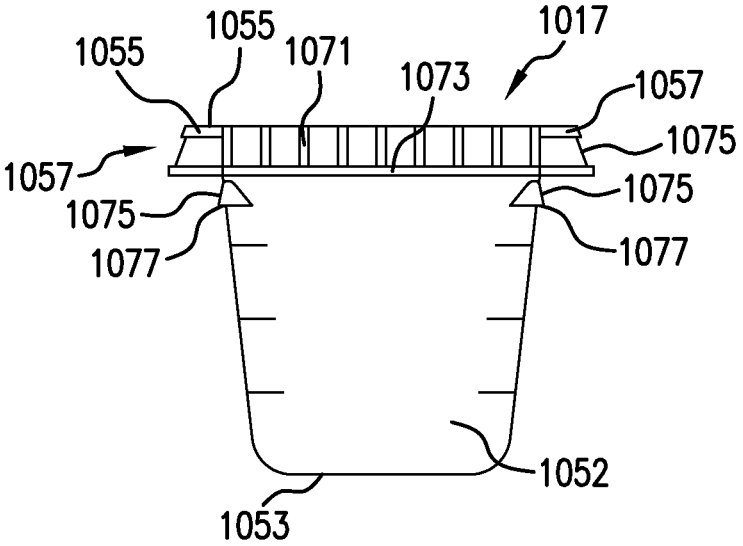
FIG. 14D is a front view of the liner, according to one embodiment of the present disclosure.
Figure 14E:
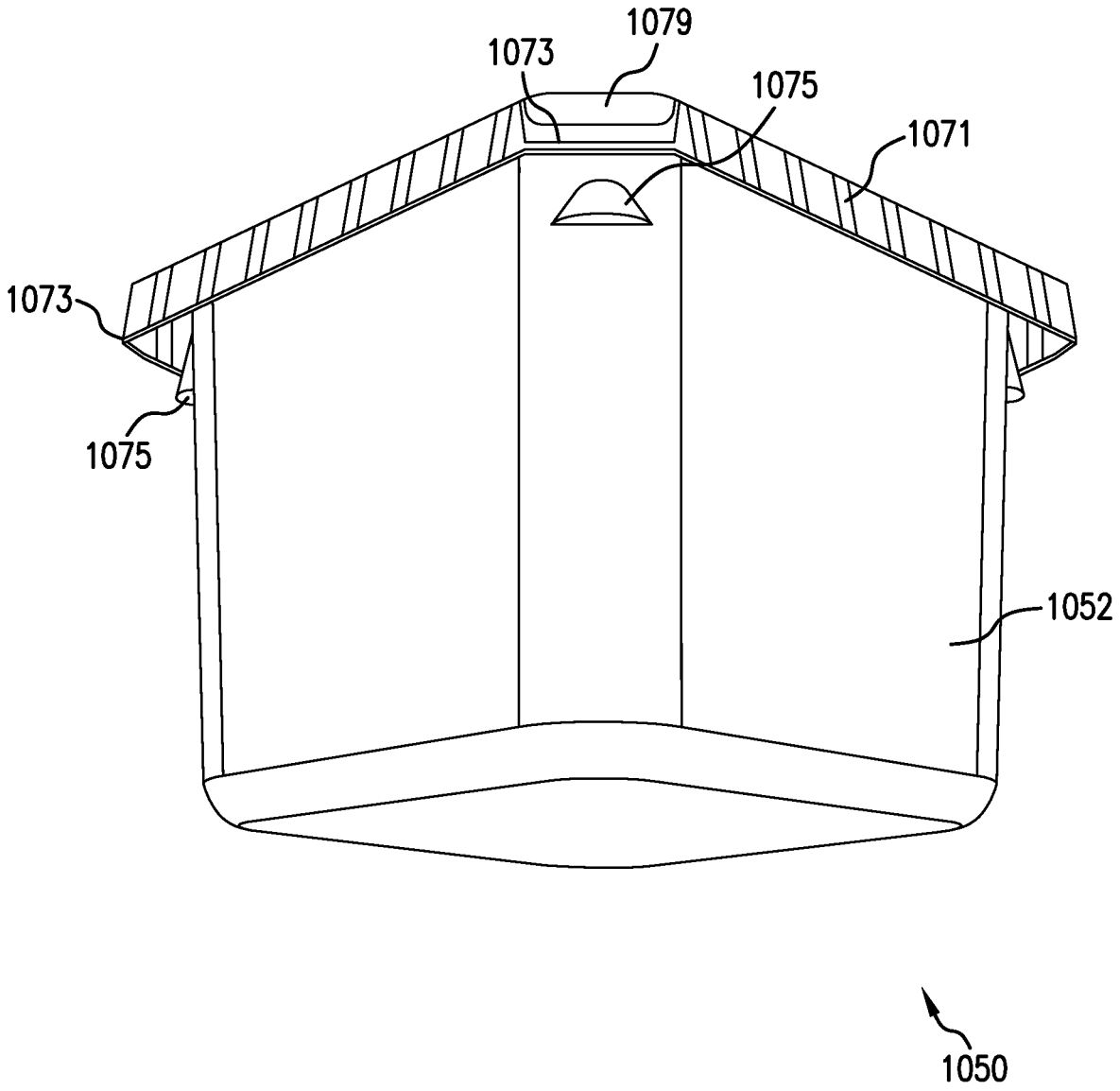
FIG. 14E is a perspective view of the liner, according to one embodiment of the present disclosure.
Figure 15:
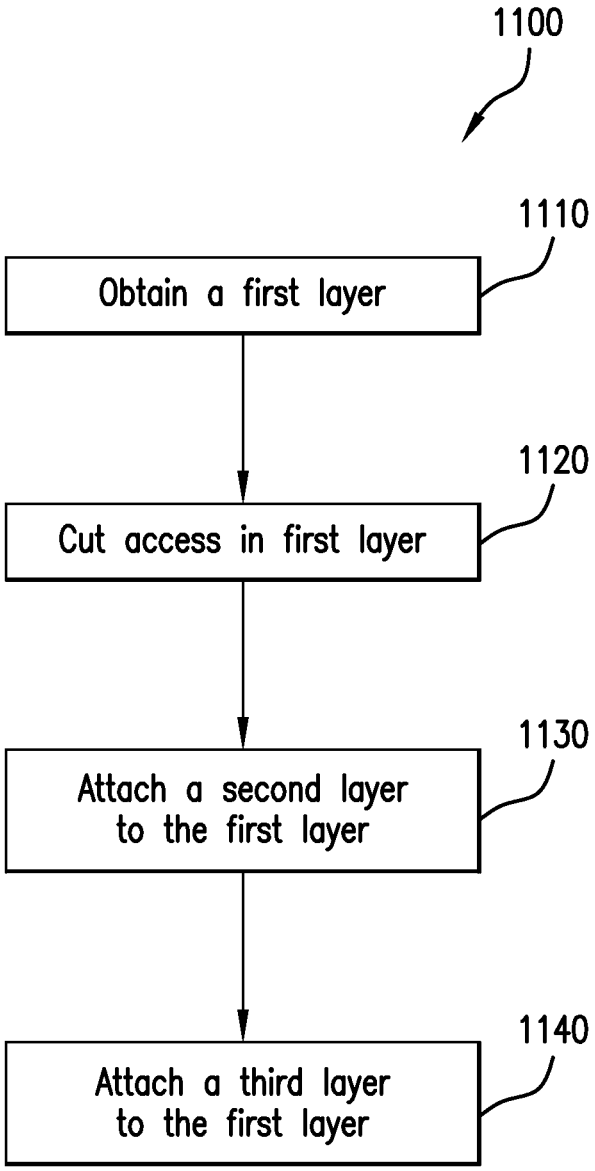
FIG. 15 is a schematic of a manufacturing facility for forming and filling the cartons, according to one embodiment of the present disclosure.

To access the contents within the plastic liner 1050, the lidding material 1006 can be broken, torn, cut, pierced through, or the like. For example, an X shaped cut may open the lidding material 1006 to provide access into the container. An example cut 1023 through the lidding material is illustrated in FIG. 13D. Preferably, the lidding material 1006 can be broken, torn, or pierced through using a sharp object such as a knife, scissors, or the like. In some configurations, an indicator or marking can be provided instructing a user the preferred area to cut.

As with other embodiments, the packaging system 1000 has sufficient strength and rigidity such that it passes the appropriate shipping tests under the International Safe Transit Association ("ISTA"). In particular, the sealed packaging system 1000 preferably has sufficient strength and rigidity to pass the ISTA-3E shipping test or an equivalent test that challenges the capability of the packaging system and contents therein to withstand transport hazards. The lidding material 1006 also preferably acts as a tamper-evident system and can indicate to the user that the packaging system 1000 has been tampered with if the lidding material 1006 is broken.

Preferably, the peel-reseal lidding material 1008 is heat-sealed along its edges 1002 to the lidding material 1006 and/or plastic liner 1050. The peel-reseal lidding material 1008 includes at least a first layer 1014 and a second layer 1024, such as a sealing layer, that are generally coextensive and adhered to each other. In the preferred embodiment, the second layer 1024 is permanently affixed to the first layer 1014 and the first layer 1014 is positioned so that it faces the interior of the plastic liner 1050. The first layer 1014 and second layer 1024 can be of substantially the same size or in some configurations, the second layer 1024 can be smaller than the first layer 1014. The lidding material 1008 may be operable to lay flat, peel back flat (e.g. FIG. 13C), and roll up (e.g. FIGS. 12 and 13D). The metallized layer may provide suitable rigidity to control the characteristics of the lidding material 1008.

In accordance with various embodiments, the liner 1050 may have any number of sides or any shape. For example, the liner 1050 may be substantially rectangular and the lidding material 1008 may have four edges 1002 corresponding to the geometry of the opening of the liner 1050. It will be appreciated that other liner geometries can be used, for example and without limitation, the opening of the liner 1050 could be circular, or polygonal with more or less than four sides.

The first layer 1014 includes a center portion 1018 and a remaining area 1019 adjacent the center portion 1018. The center portion 1018 is positioned at a predetermined distance from the edge 1002 of the peel-reseal lidding material 1008. The center portion 1018 is detached from the remaining portion 1019 along at least one edge 1022 such that the center portion 1018 is movable to expose the lidding material 1006 (which may be considered a second lidding material) thereunder. The lidding material 1006 may be defined by at least one edge 1027. The lidding material 1006 may be sealed to the remaining portion 1019 and the center portion 1018 across the detached edge 1022. The peel-reseal lidding material 1008 is resealable to seal the contents in the plastic liner when the lidding material is broken. The center portion 1018's detached edge 1022 may terminate in an inwardly turning curve 1029. In another example, as illustrated in FIG. 13G, 1022 may terminate in an outwardly turning curve 1031. The curve (inwardly or outwardly curving) turns at least 90°. The curve 1029, 1031 may turn about 180°. The termination points 1033 wraps back around toward where the center portion 1018 opens such that as the center portion opens and folds across a hinge section 1015, stress is reduced on the edge termination because the opening action is not pulled towards the termination but away from it, reducing the likelihood of tearing. Once the center portion 1018 is moved to an open position, the second lidding material 1006 is exposed thereunder.

In various examples, the center portion 1018 may be defined by the at least one edge 322. The one edge may make a single slit for axis or it may make any of a variety of shapes to create an opening in the first layer 1014. In various examples, the center portion 1018 may be defined by four edges as illustrated in FIGS. 13A-G. Although as illustrated in FIG. 13F, the at least one edge can have a variety of forms some of which are illustrated as examples, but a person of skill in the art would recognize that based on this disclosure any shape may be utilized. In one example, at least three of the edges. The detached edges 1022 may be perforated, cut, or slit that separates the three edges of the center portion 1018 from the remaining area 1019 of the first layer 1014. The fourth or remaining edge of the center portion 1018 is preferably affixed to the remaining area 1019 to act as a hinge 1015 so that the center portion 1018 can be pulled back to expose the lidding material 1006 thereunder. The center portion 1018 of the peel-reseal lidding material 1008 can then be resealed to seal the open area 1017 of the plastic liner 1050 when the lidding material 1006 has been broken. As the first layer is opened via the hinge, the second layer 1024 remains attached to the center portion 1018 while releasing from the remaining edge 1018.

The reseal is possible because an adhesive portion 1026 overlaps the detached edges 1022 from the center portion 1018 to the remaining area 1019, such that when the adhesive portion 1026 is attached to the remaining area 1019 it is also attached to the center portion 1018, thereby sealing the peal-reseal lidding material 1008. Adhesive portion 1026 may be a distance of D wide as illustrated in FIGS. 13B-C. D may be typically be greater than ⅛ of an inch. In various examples, D may be from ¼ to ½ inch wide. The adhesive portion 1026 includes a resealable adhesive 1010 on the bottom surface of the adhesive portion 1026 facing the interior of the plastic lid 1002. As the user pulls back the center portion 1018, the adhesive portion 1026 is also pulled back with the center portion 1018. The adhesive portion 1026 preferably includes a resealable adhesive material that can seal and reseal multiple times to facilitate resealing the center portion 1018 against the peel-reseal lidding material 1008, for example, against the portion of the first layer 1014 adjacent the center portion 1018 and edge 1002. The 1024 also extends across the curve 1029 and termination points 1033.

As indicated above, the peel-reseal lidding material 1008 includes a tab 1012. The tab 1012 may have similar adhesion to the rest of second layer 1024 or the tab 1012 may have lower adhesion as compared to the rest of the layer 1024. In various embodiments, tab 1012 may not be adhered to the lidding material 1006. This may allow the user to easily grasp the tab 1012 and pull back the center area 1018 of the peel-reseal lidding material 1008 from the lidding material 1006. In some configurations, the tab can be a portion of either the first layer 1014 or second layer 1024. In yet other configurations, no tab can be provided. In one example, the center portion's 1018 detached edge 1022 includes a first edge 1035 and a second edge 1037 (see FIG. 13C). The peel-reseal lidding material 1008 includes a corner tab 1012 that is defined by an area where the first edge 1035 and the second edge 1037 meet at a corner. The tab is operable to extend away from the surface of peel-reseal lidding material 1008 such that it can be gripped and pulled. Tab 2012 may be movable such that it can be operatively pulled away from the first lidding material 1014. This separation from lidding material 1014 allows for separation between the portion of second layer 1024 and first layer 1014 which is attached along the remaining portion 1019. This attachment may be adjacent the first edge 1035 and the second edge 1037. The second layer 1024 is separable from the remaining portion 1019 starting at a point on either side and proximate to the tab 2012. The separation continues to move along both the first edge 1035 and the second edge 1037 as the tab is further moved from the first lidding material 1014. The separation progresses moving distally away from the tab 1012 as the tab 1012 is separated from the first lidding material 1014. In yet other configurations, the tab can be located at an intermediate length along any edge, or no tab can be provided.

FIG. 14A-D illustrates various embodiments of liner 1050. With regard to the various embodiments as illustrated in FIGS. 14A-E, all other embodiments, features, and examples described with regard to other embodiments may also be combined herein. The liner 1050 may comprise at least one side wall 1052. In the example shown in FIGS. 14A-E, the liner 1050 includes four side walls 1052 and a bottom wall 1053. The four side walls 1052 define an open area 1017. At the termination of the side walls 1052 distal to the bottom wall 1053 is a rim 1056. The rim 1056 may include a flange 1055 which extends outwardly (i.e. away from each of the side walls 1052.) The flange 1055 may include a skirt 1057. The skirt 1057 may extend downwardly (i.e. toward a plane defined by the bottom wall but not toward the side walls).

In accordance with various embodiments, the liner 1050 includes a plurality of positioning features. The liner 1050 is operable to be located inside of a carton 1072. The carton includes walls 1074 that define its perimeter. The liner 1050 and the cavity defined by walls 1074 may nest within each other, such that liner 1050 can be located inside of the interior of carton 1072. The liner 1050 may none-the-less shift within the carton. The packaging assembly 1000 is operable to be used safely and securely with a broad range of contents. As such, in various embodiments a snug fit between carton 1072 and liner 1050 may improve the utility of the packaging assembly 1000. To that end in various embodiments, the package assembly 1000 may include non-movement elements. Non-movement elements may include protrusions that contact the carton 1072. For example, these may include skirt ribs, wall protrusions, specialized corners, or any feature which limits movement between the carton and the liner.

In various examples, a liner 1050 may rest on the top edge of wall 1074 via the flange portion 1055 which extends from the rim of liner 1050. The skirt 1057 provides a pocket between the side wall 1052 and the interior surface 1059 of skirt 1057 to receive wall 1074 to aid in a more snug fit for the packaging assembly 1000. The skirt may also include a plurality of ribs 1071. The plurality of ribs 1071 may extend from or into the surface 1059 of skirt 1057. The plurality of ribs 1071 extend from the flange portion 1055 down to the end of the skirt. By forming these protrusions into or away from the skirt 1057, the surface 1059 of the skirt is strengthened. The ribs may also act spacers to form a better fit around the wall 1074. For example, ribs 1071 may extend toward side wall 1052 at a plurality of finite points. These finite points could interfere with the wall or merely close the gap toward the wall 1074 when the liner 1050 is installed in a carton 1072 and the wall 1074 extends into the cavity between the skirt 1057 and the side wall 1052. Because the points are spread and friction and pressure are minimized, even if they interfere, they may not prevent the liner 1050 from mating with the carton 1072. The skirt 1057 may also include a flare 1073 that extends away from the side wall. The flare 1073 may also extend around the perimeter. The flare may be operable to help the skirt 1057 receive the wall 1074 when inserting the liner 1050 into the carton 1073. As the flare 1073 extends away from the side wall 1052, the flare 1073 forms a wider entrance for receiving the wall 1074 into the gap between skirt 1057 and the side wall 1052.

The outer corner for the skirt may be any type of corner. For example, it could be round like the wall 1052 intersection. In another example, the skirt corner could be different than the wall 1052 corner. For example, the skirt corner may be a shape that helps secure the carton 1073. In one example, side walls 1052 may include a rounded corner proximate the side wall and the skirt may include a outer corner proximate the skirt. The outer corner may interface with other elements (see below) or its shape, alone, may improve pressure on the carton with the resultant improved fit.

The skirt includes a rib 1079 which extends generally parallel with the flange portion on at least one of the outer corners on the side of the skirt. The rib 1079 may be located proximate the flange portion. The rib may form a ledge the aids in grabbing to lift the liner 1050 or the rib may be a stiffening feature.

In accordance with various embodiments, the side walls 1052 may include features to improve fitment with the carton. For example, on each of the corners of the side walls 1052 a protrusion may be located adjacent the end of the skirt. The protrusion 1075 may be located opposite the skirt and separate from the protrusion 1075 by the flange portion. In this way there is a gap between the end of the skirt and the protrusion. As stated above, the skirt may have a outer corner connection and the corner connection may be located adjacent another feature such as the protrusion 1075, which may also be located on the corners. As such, the carton may even receive a tighter fit when positioned between the outer corner and the protrusion 1075. The protrusion may be located anywhere on the liner 1050 such that it is operable to exert outward pressure when the liner is slid into a carton 1072. However, by placing the protrusion 1075 opposite the skirt 1057, a sandwich is formed, thereby potentially increasing the pressure from both sides on the wall 1074 and improving the fitment. The protrusion 1075 may be a protrusion that curves out and away from the side wall 1052. The protrusion 1075 may have a smaller curvature than the surface of sidewall 1052 such as the surface at the rounded corner. The smaller curvature may result in improved contact between an outer surface of the protrusion and the carton as compared to an outer surface of the rounded corner. This is because the smaller curvature may make closer and more complete contact with the carton in a place such as a corner. In accordance with various embodiments, the protrusion 1075 may include a rib 1077. The rib 1077 may bisect the protrusion extending from a side of the protrusion 1075 proximate the bottom wall 1053 to a side of the protrusion proximate the flange 1055. The rib 1077 may add strength to the protrusion such that it is able to exert more outward pressure such as on the carton 1072.

In accordance with an exemplary method 1100 of forming the peel-reseal lidding assembly 1040, the first layer may be obtained (step 1110). The first layer as discussed above may be a metallized OPP layer. This may come on large bulk rolls of material. The center portion may be cut into the first layer (step 1120). As discussed briefly above, the first layer may be cut, torn, perforated or the like to form the detached edge that defines the center portion. Once the first layer is prepped and the center portion is formed, the first layer may be attached to an additional layer. In one embodiment, it may be attached to the second layer which may be the layer that peels and reseals with the first layer. Alternatively, the third layer of material may be attached to the first layer next (step 1140). Either order is contemplated herein. The third layer of material may be the lidding material 106 which may function as the tamper evident seal. The third layer may be heat-sealed to the first layer. The two layers may be cut such that they are coextensive with one another. A finalized product may be formed of a plurality of layers. Each may provide a separate function, e.g. tamper evident, oxygen barrier, peel-reseal characteristics.

Figure 16:
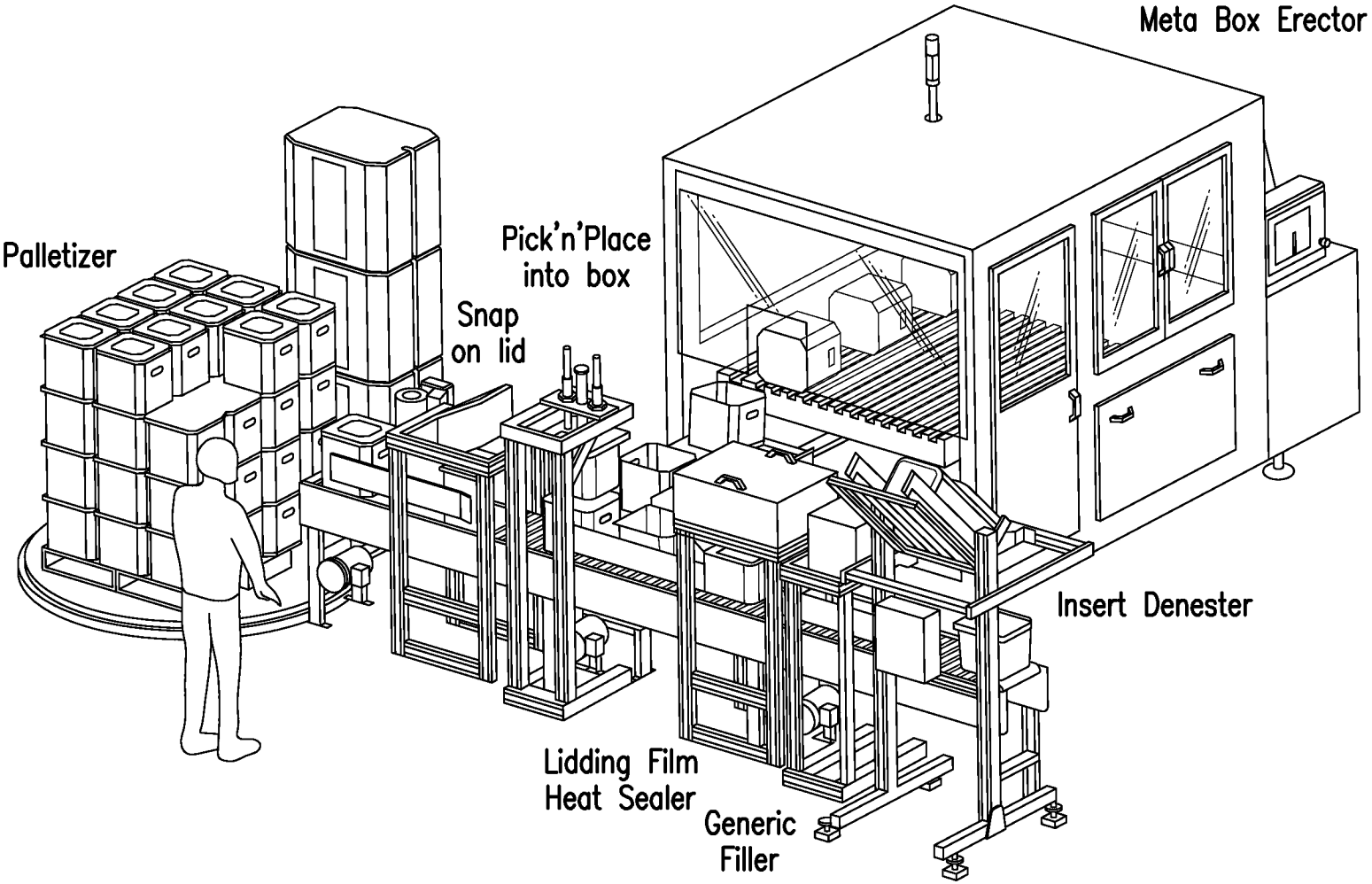
FIG. 16 is an exemplary flow diagram illustrating a method of layering the lidding

In accordance with an exemplary process, as illustrated in FIG. 16, a system may prepare the packaging assembly 1000 on a production line. The system may receive cartons from a box erector, obtain liners, fill the liner, seal the peel-reseal assembly onto the liner, place the liner into the carton, places a carton lid onto the carton, and then palletizes the final packaging assembly.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

We claim:

1. A shippable material system, comprising:

a self-supporting liner for holding contents therein and having a side wall, a closed bottom end characterized by a bottom wall formed integral with the side wall, and an open top end having an outwardly-projecting rim, the rim comprising a flange portion; and a peel and reseal lidding assembly that is heat-sealed to the self-supporting liner at the open top end operably sealing the contents therein, the peel and reseal lidding assembly including:

a first lidding material defined by at least one edge and having a center portion movable to form an opening through the first lidding material and a remaining portion, with the center portion being at least partially detached from the remaining portion along at least one edge of the center portion; and a second lidding material covering the opening, wherein the center portion is movable to expose the second lidding material thereunder; and a third lidding material defined by at least one edge that is sealed to the remaining portion and the center portion across the detached edge, wherein the third lidding material is resealable to seal the contents in the self-supporting liner when the second lidding material is broken.

2. The shippable material system of claim 1, wherein the center portion's at least one edge terminates at an edge termination, in one of at least an inwardly turning curve or an outwardly turning curve either one of which turns at least 90° such that stress is reduced on the edge termination when the center portion is moved exposing the second lidding material thereunder.

3. The shippable material system of claim 1, wherein the third lidding material extends across a surface area of the center portion and an edge termination of the at least one edge of the center portion, wherein the third lidding material extends off the center portion's surface area, past the at least one edge by more than ⅛ of an inch.

4. The shippable material system of claim 2, wherein the center portion's at least one edge is a first side edge and a second side edge connected by a front edge, wherein the side edges terminate as mirror images of one another.

5. The shippable material system of claim 3, wherein the center portion's at least one edge is at least a first edge and a second edge, wherein the third lidding material includes a corner tab defined by an area where the first edge and the second edge meet at a corner; the tab being operably extending to be gripped and pulled, wherein as the corner tab is movable away from the first lidding material such that the portion of the third lidding material attached to the remaining portion, that is adjacent the first edge and the second edge, is separable from the remaining portion starting at a point proximate to the tab and progressing distally from the tab as the tab is moved away from the first lidding material.

6. The shippable material system of claim 1, wherein the first lidding material is one of at least a metallized or a layer of thin metal which provides stiffness to the peal and reseal lidding assembly sufficient to spread out a resealing force along a perimeter of the third lidding material when a force is applied to reseal the third lidding material to the remaining portion.

7. The shippable material system of claim 1, wherein the third lidding material and the center portion are shaped such they can be rolled and attached to one of at least the peel and reseal lidding assembly, the self-supporting liner, or a carton in which the self-supporting liner is located.

8. The shippable material system of claim 3, further comprising a carton, wherein the self-supporting liner rests on and is supported by a bottom wall of the carton.

9. The shippable material system of claim 3, further comprising a carton lid fitting over the carton, the peel and reseal lidding assembly, and self-supporting liner.

10. The shippable material system of claim 1, wherein the self-supporting liner is made of recyclable high-density polyethylene.

11. The shippable material system of claim 1, further comprising a material disposed within the self-supporting liner forming the contents therein.

12. The shippable material system of claim 11, wherein the material is at least one of a liquid, viscous, or particulate product.

13. The shippable material system of claim 11, wherein the self-supporting liner includes a portion that is octagonally shaped.

14. The shippable material system of claim 8, wherein the outwardly-projecting rim operably holds the open top end of the self-supporting liner outwardly biased toward the carton.

15. The shippable material system of claim 14, wherein as the first lidding material is affixed to the flange of the self-supporting liner, the flange of the self-supporting liner positions outer edges of the first lidding material relative to the carton.

16. The shippable material system of claim 1, wherein the rim further comprises a plurality of ribs suitable to provide rigidity to a portion of the rim and grip the carton.

17. The shippable material system of claim 1, wherein the second lidding material is a tamper evident layer that is heat-sealed to the self-supporting liner and is configured to be opened by cutting through a center portion of the second lidding material.

18. A shippable material system, comprising:

a self-supporting liner for holding contents therein and having a side wall, a closed bottom end characterized by a bottom wall formed integral with the side wall, and an open top end having an outwardly-projecting rim, the rim comprising a flange portion; and a peel and reseal lidding assembly for sealing any contents of the self-supporting liner therein, the peel and reseal lidding assembly including:

a peel-reseal lidding material having:

an outer layer defined by at least one edge, and a central layer defined by at least one edge, the central layer having a center portion and a remaining portion with the center portion being at least partially detached from the remaining portion along at least one edge of the center portion such that the center portion is movable to form an opening through the central layer, wherein the outer layer is sealed to the remaining portion and the center portion of the central layer across the detached edge; and a tamper evident layer disposed underneath the peel-reseal lidding material, the tamper evident layer being heat-sealed to the self-supporting liner and configured to be opened by cutting through a center of the tamper evident layer;

wherein the outer layer and the center portion of the central layer of the peel-reseal lidding material are movable to expose the tamper evident layer thereunder, and the outer layer is configured to be resealable to the remaining portion of the central layer in order to seal the contents in the self-supporting liner when the tamper evident layer is broken.

* * * * *